US005744742A

United States Patent [19]

Lindemann et al.

[11] Patent Number: 5,744,742

[45] Date of Patent: Apr. 28, 1998

[54] PARAMETRIC SIGNAL MODELING MUSICAL SYNTHESIZER

[75] Inventors: Eric Lindemann; Jeffrey Barish, both of Boulder, Colo.

[73] Assignee: EuPhonics, Incorporated, Boulder, Colo.

[21] Appl. No.: 808,676

[22] Filed: Feb. 28, 1997

Related U.S. Application Data

[63] Continuation of Ser. No. 551,840, Nov. 7, 1995, abandoned.

[51] Int. Cl.[6] ..... G10H 1/00; G10H 1/12

[52] U.S. Cl. ..... 84/623; 84/604; 84/626; 84/661; 84/DIG. 9; 364/723; 364/724.1

[58] Field of Search ..... 84/604–608, 622–624, 84/626, 627, 661, 663, DIG. 9; 364/723, 724.01, 724.1

[56] References Cited

U.S. PATENT DOCUMENTS

| | | | |
|---|---|---|---|
| 5,029,509 | 7/1991 | Serra et al. | 84/625 |
| 5,111,727 | 5/1992 | Rossum | 84/603 |
| 5,149,902 | 9/1992 | Washiyama | 84/622 |
| 5,229,534 | 7/1993 | Suzuki | 84/627 |
| 5,248,845 | 9/1993 | Massie et al. | 84/622 |
| 5,500,486 | 3/1996 | Smith, III | 84/622 |
| 5,504,833 | 4/1996 | George et al. | 395/2.2 |
| 5,610,942 | 3/1997 | Chen et al. | 375/242 |

OTHER PUBLICATIONS

Crochiere et. al "Multirate Digital Signal Processing," Prentice–Hall, 1983.

Gersho et. al "Vector Quantization and Signal Compression," Kluwer Academic Publishers, 1992.

Markel et. al "Linear Prediction of Speech," Springer–Verlag, 1976.

J.O. Smith "Techniques for Digital Filter Design and System Identification with Application to the Violin," Ph.D dissertation, Stanford University 1983, pp. 61–73, 131–137.

*Primary Examiner*—William M. Shoop, Jr.
*Assistant Examiner*—Marlon T. Fletcher
*Attorney, Agent, or Firm*—Macheledt Bales & Johnson LLP; Jennifer L. Bales

[57] ABSTRACT

A parametric signal modeling musical tone synthesizer utilizes a multidimensional filter coefficient space consisting of many sets of filter coefficients to model an instrument. These sets are smoothly interpolated over pitch, intensity, and time. The filter excitation for a particular note is derived from a collection of single period excitations, which form a multidimensional excitation space, which is also smoothly interpolated over pitch, intensity and time. The synthesizer includes effective modeling of attacks of tones, and the noise component of a tone is modelled separately from the pitched component. The input control signals may include initial pitch and intensity, or the intensity may be time-varying. A variety of instruments may be specified.

48 Claims, 26 Drawing Sheets

PARAMETRIC SIGNAL MODELING MUSICAL SYNTHESIZER

This application is a continuation of application Ser. No. 08/551,840, filed Nov. 7, 1995, now abandoned.

BACKGROUND OF INVENTION

1. Field of the Invention

This invention relates to music synthesizers. In particular, this invention relates to parametric signal modeling musical synthesizers.

2. Description of the Related Art

Wavetable synthesis, also known as sampling synthesis, is a popular electronic music synthesis technique, often used for simulating real instruments. With this approach, musical tones from a real instrument are recorded digitally and stored in computer memory. To play a simulated tone from the electronic instrument, one of the recorded musical tone is read from computer memory, passed through a set of transformations, and then output through a digital-to-analog converter.

It is often impractical, due to memory limitations, to record tones of all possible pitches from an instrument. Therefore, in order to simulate a tone of any arbitrary pitch, it is necessary to pitch shift one of the recorded tones up or down. This pitch shifting is one of the key real-time transformations applied to recorded tones in wavetable synthesis.

It is also desirable to limit memory usage in wavetable synthesis by recording tones of limited duration —one to two seconds is typical. Since musical tones must often be sustained for arbitrary periods of time, another important transformation in wavetable synthesis is "looping" which repeats a short section of a recorded tone over and over to simulate sustain. This kind of repetition can sound artificial and mechanical. So, often a time-varying amplitude envelope is applied to the looping tone to provide variation. Tremolo, slow decay, and even random variations are commonly applied using this amplitude envelope.

There are a number of problems associated with wavetable synthesis as described above. The process of pitch shifting introduces unnatural changes in timbre in a recorded tone. In particular, when a tone is pitch shifted up it often sounds tinny or "munchkinized". Analogous distortions occur when a recorded tone is pitch shifted down too much. These distortions limit the amount that a recorded tone can be pitch shifted. Therefore, to cover the pitch range of the instrument, multiple tones must be recorded so that each individual tone is only pitch shifted over a limited range. One-fourth to one-half octave pitch shift ranges are typical.

Even for notes of the same pitch, real musical instruments usually have different characteristics depending on whether a note is played loudly or softly. So wavetable synthesizers sometimes record multiple tones of different intensities over the same pitch range. The selection of the appropriate recorded tone is then a function of both pitch and intensity. We use the term intensity to refer to the overall characteristic of a tone which comes from how loudly or softly the performer plays it. This is to be distinguished from the time-varying amplitude envelope of a particular tone. Some wavetable synthesizers, rather than record multiple tones at different intensity levels, use programmable filters to simulate the timbre differences between loud and soft tones, with softer tones usually simulated by playing recordings of loud tones at lower amplitude and through a lowpass filter.

Not only is this recording of multiple tones across the pitch and intensity range of an instrument costly in memory, it also results in unnatural discontinuities in timbre at the transition point between tones. To help with this some wavetable synthesizers have attempted to crossfade between adjacent tones in pitch and/or intensity. Unfortunately, this approach often gives the undesirable impression that two different tones are being played. This is due to differences in the phase relationships and pitch between the crossfaded tones. The crossfading approach also consumes more computational resources in the system.

Despite attempts to cover up the defects of looping with interesting amplitude envelopes, there is still often undesirable artifacts using this approach to sustain simulation. If loops are long—on the order of half a second—then there are usually audible discontinuities at the loop edge. To smooth these discontinuities crossfading is used across the loop splice. This results in a kind of "wah-wah" chorusing artifact. Short loops, for example the length of a single pitch period, don't suffer from these problems, but are none the less problematic since they have a completely static timbre, sounding like an electronic oscillator. For certain instruments, especially those such as the piano which have out of tune harmonics, it is often difficult to find a single period loop which does not have discontinuities at boundaries.

Traditional wavetable synthesizers also often suffer from a general lack of expressivity and naturalness due to the fact that every time a note is played the same recording is used, and so there is no real variation, except that introduced by randomization of the amplitude envelope, between one realization of a tone and the next.

Massie et al., in U.S. Pat. No. , discloses an invention which attempts to address many of these issues. The invention is based upon separation of tones of an instrument into a formant filter and residual excitation signal. This approach is inspired by speech processing technology in which it is common to model the vocal tract as a wide bandwidth, relatively flat spectrum, excitation signal from the glottis which is then filtered by the mouth and nasal cavities which, with the movements of the tongue, jaw and lips, function as a time-varying filter. Much has been written about this kind of speech processing technique including ways in which a real speech signal can be encoded as a combination of residual excitation signal together with coefficients of a time-varying filter, and ways in which electronic voice synthesis can be accomplished by generating synthetic excitations, and passing them through appropriate time-varying filters. The kinds of signal analysis techniques used in this kind of speech processing are variously termed Linear Predictive Coding (LPC), Autoregressive Coding (AR), Moving Average Coding (MA), and Autoregressive Moving Average Coding (ARMA). Collectively, these approaches are Parametric Signal Modeling (PSM) techniques. This is the term we will employ in this presentation.

In the Massie et. al. disclosure, musical instruments are viewed as systems which produce an excitation which is then passed through a formant filter. An example is the bow/string system of the violin which produces an excitation which is then filtered by the formant filter frequency response of the violin body. The invention of Massie et. al. uses PSM analysis to determine a single instrumental formant filter for a given instrument. To arrive at the instrumental formant filter, as distinct from a filter which might be deduced from a recording of a single tone at a specific pitch and intensity of the instrument, Massie et. al. generates a composite instrumental signal which is then analyzed. This composite signal is either an "averaging" of several recorded tones across the pitch range of the instrument, or is a simple mixture—a chord—of tones played by the instrument. In Massie et. al., the original recorded tones of different pitches are then passed through the inverse of the instrumental formant filter to generate a set of residual excitation signals. These excitation signals are then vector quantized. Vector Quantization (VQ) is another technique common to speech processing. To play a tone, excitation segments from a VQ codebook are concatenated, and an envelope is applied to generate a simulation of the original excitation signal which is then pitch shifted to a desired pitch and passed through the instrumental formant filter. The claim is that by extracting the instrumental formant filter, pitch shifting of excitation signals can occur over a much wider range than with traditional wavetable synthesis without causing unreasonable timbral distortion. This would reduce memory requirements, since fewer tones—in this case, excitation signals—must be stored in memory. In addition, the process of vector quantization and the fact that the residual excitation variance is smaller than the original signal also reduces the amount of memory required for the system. In general, in the Massie et al. system, the instrumental formant filter captures the general timbral shape of the instrument while the encoded excitation captures the instantaneous dynamic variations, and the variations across pitch.

The system described by Massie et. al. has a number of problems due to its attempt to use a single basic formant filter to characterize an instrument. If residual excitations are generated from recordings of different pitches, then, since part of the timbre is encoded in the residual, timbral discontinuities will still occur at the crossover between residual excitations of different pitches. In addition, in order to capture timbral variation across the entire instrument, the vector quantization codebook may have to be large, resulting in high memory usage. Looping artifacts will still occur similar to traditional wavetable synthesis.

The Massie et al. patent attempts to define an instrument wide formant filter, which means that much of the timbral variation inherent in the instrument across pitch, and intensity is forced into the encoding of the residual. The resulting complexity of the residual means that increased memory storage is required to achieve a given perceptual quality. The complexity of the residuals also means they cannot be conveniently interpolated across pitch and intensity which results in timbral discontinuities across the pitch and intensity instrument space.

A need remains in the art for a parametric signal modeling musical synthesizer which uses less memory than previous synthesizers while producing natural, expressive sound, by utilizing a multidimensional filter coefficient space consisting of many sets of filter coefficients, which may be interpolated over pitch, intensity and time.

SUMMARY OF THE INVENTION

An object of the present invention is to provide a musical synthesizer which gives greater musical expressivity and naturalness while using less device memory than conventional musical synthesizers.

The parametric signal modeling musical synthesizer, according to the present invention, utilizes a multidimensional filter coefficient space consisting of many sets of filter coefficients.

The present invention uses Parametric Signal Modeling, but instead of extracting a single basic formant filter associated with the instrument, a multidimensional filter coefficient space consisting of many sets of filter coefficients is constructed. The coefficients are then smoothly interpolated over pitch, intensity and time.

In addition, the filter excitation for a particular note is derived from a collection of single period excitations, which form a multidimensional excitation space which is also smoothly interpolated over pitch, intensity, and time.

The system further includes means for effectively modeling attacks of tones, and for modeling the noise component of a tone separately from the pitched component. The attack related elements are also arranged in a multidimensional pitch, intensity, time space which can be smoothly interpolated.

The ability to smoothly interpolate all quantities—filter coefficients, residual excitations, and attack related elements, in multiple dimensions of pitch, time, and intensity, insures that no discontinuities occur over the range of the instrument. The multidimensional, completely interpolable filter coefficient, residual excitation, and attack element spaces together form an Instrument Parameter Space (IPS). When it is desired to synthesize a tone of a particular pitch and intensity, specific instances of a residual excitation, a time-varying sequence of filter coefficients sets, and a pitch and intensity envelope are generated by interpolating in the Instrument Parameter Space based on the desired input pitch and intensity control variables.

The structure of the Instrument Parameter Space and the ability to interpolate all quantities based on the input pitch and intensity variables alleviates many problems associated with both traditional wavetable synthesis, and with previous attempts at using Parametric Signal Modeling for music synthesis.

The ability to model most of the time-varying characteristics of a musical tone with time-varying filter coefficients, amplitude envelopes, and pitch envelopes leads to great reductions in the memory required to encode a tone, compared with traditional wavetable synthesis. In addition, the structure of the Instrument Parameter Space results in an extremely malleable representation of a musical instrument which not only makes it possible to ensure continuity of time-varying timbre across the pitch and intensity space of the instrument, but also permits many manipulations which enhance the musical expressivity of the synthesis system.

As will be seen, the various elements of the Instrument Parameter Space are designed to make very efficient use of memory resources with an acceptable increase in computational resources compared to traditional wavetable synthesis.

DESCRIPTION OF THE PREFERRED EMBODIMENTS

Figure 1:
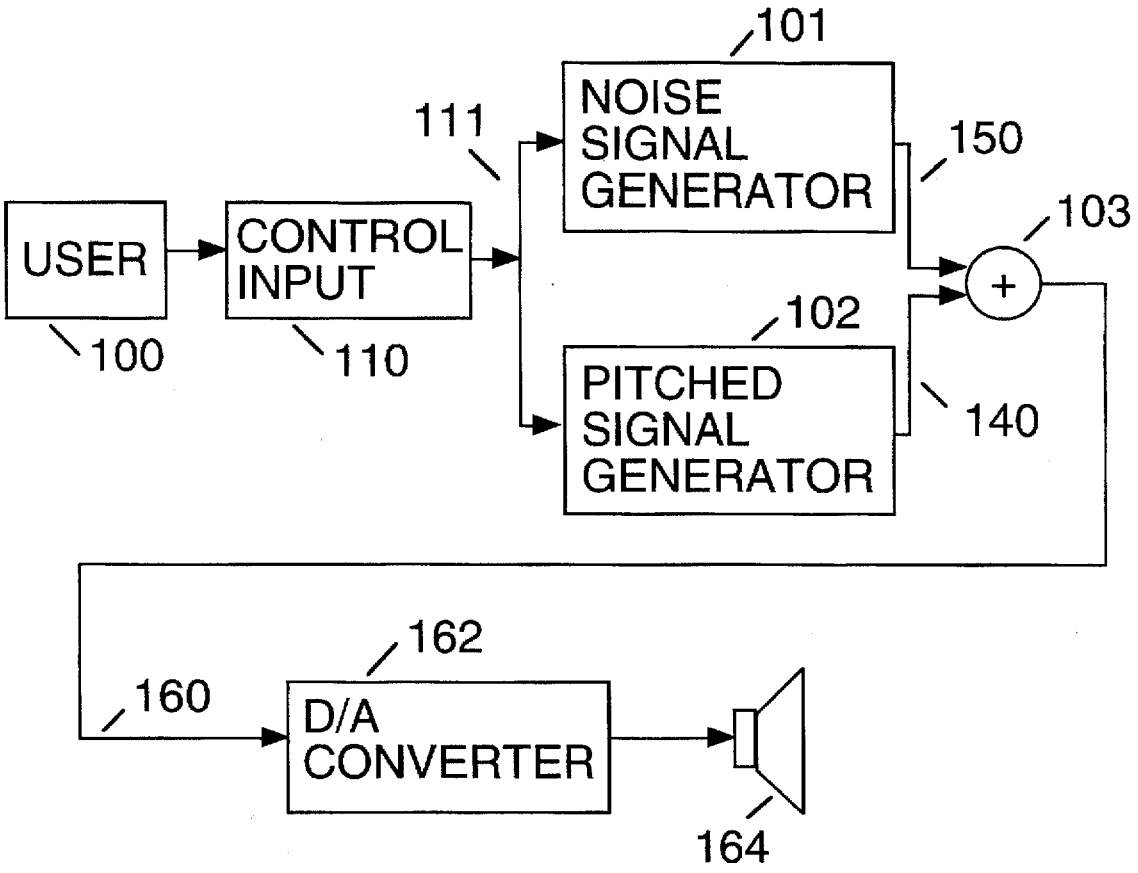
FIG. 1 shows a high level block diagram of a parametric signal modeling music synthesizer according to the present invention

FIG. 1 shows a high level block diagram of a parametric signal modeling music synthesizer according to the present invention. In a typical configuration, a user 100 selects an instrument and requests a particular tone through an input device 110, such as a keyboard. Electronic control signals 111 typically specify at least the instrument and an initial pitch and intensity. Audio output 160 of this musical tone is the sum 103 of two components: a pitched part 140 generated by pitched signal generator 102, and a noise part 150 generated by noise signal generator 101. Separating a tone into these two components makes each component easier to model. Audio output 160 is then typically run through a digital-to-analog converter 162 to a speaker 164. Those skilled in the art will appreciate that the synthesizer of the present invention could be part of a larger system including further signal processing and/or capability to receive input signals from; for example, a computer.

The pitched part 140 contains only components which are multiples of the fundamental, possibly time-varying, pitch. Many realistic musical sounds can be modeled with only a pitched part. Examples are a clear trumpet sound, and often the low notes of a piano. Other tones sound artificial unless there is both a pitched part 140 and noise part 150. Examples are the high notes of a piano for which the noise part 150 is a characteristic low frequency knock which dies away after about one second. Without this knock, the pitched part 140 alone of the high pitch piano note sounds thin and electronic. Some tones are moderately enharmonic. They can often be viewed as pitched tones with out-of-tune harmonics. Piano tones, especially low pitched tones, exhibit this behavior. While the preferred embodiments described in this disclosure do not directly model this kind of enharmonicity, it will be shown that the slow beating effects associated with this moderate enharmonicity can be simulated with the time-varying filtering capabilities of the system. Other sounds are very enharmonic. Examples of these are cymbals and gongs. This invention does not directly address the modeling of these kinds of sounds.

Figure 2:
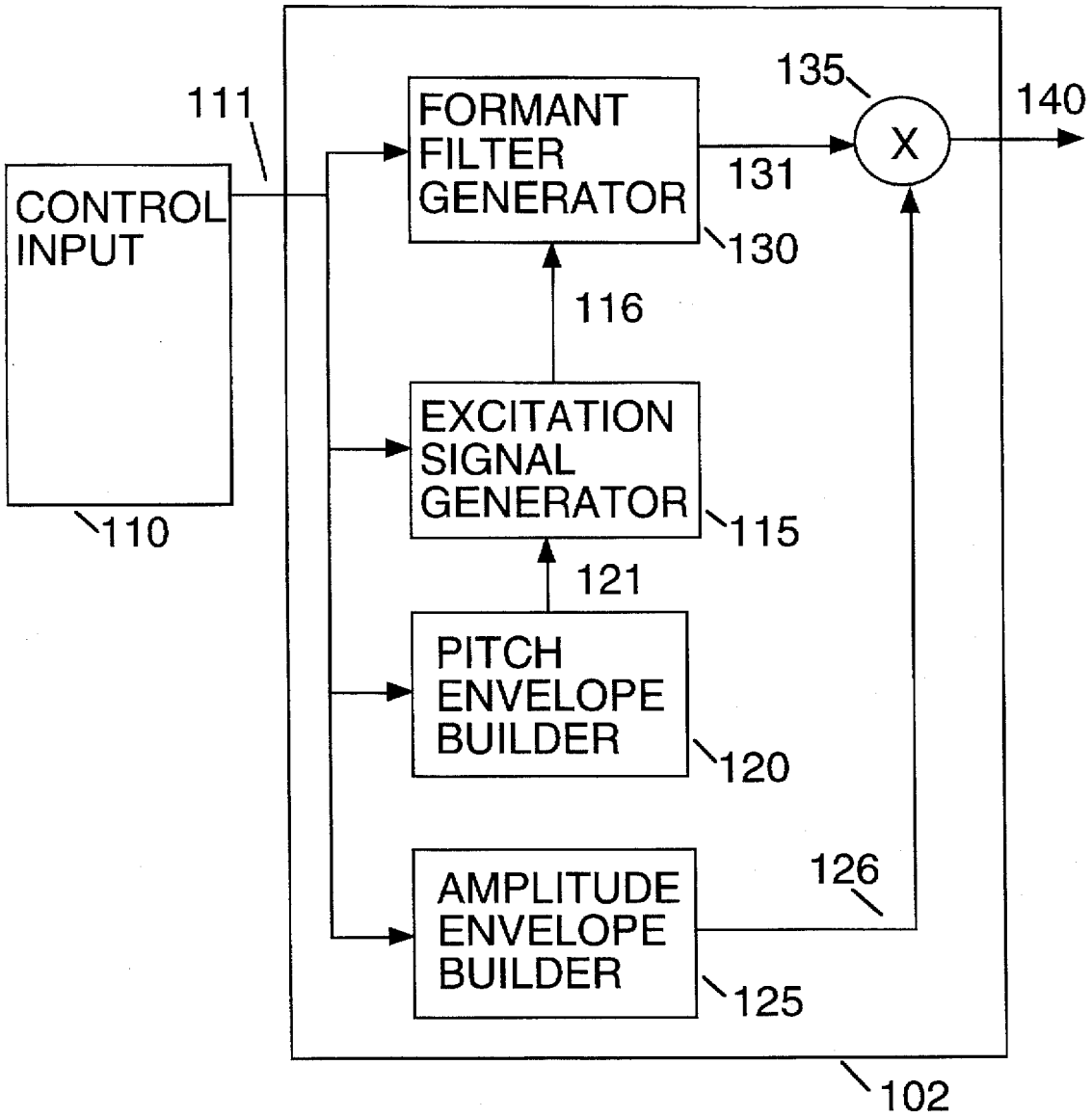
FIG. 2 shows an intermediate level block diagram of the pitched signal generator block of the parametric signal modeling music synthesizer of FIG. 1.
Figure 3:
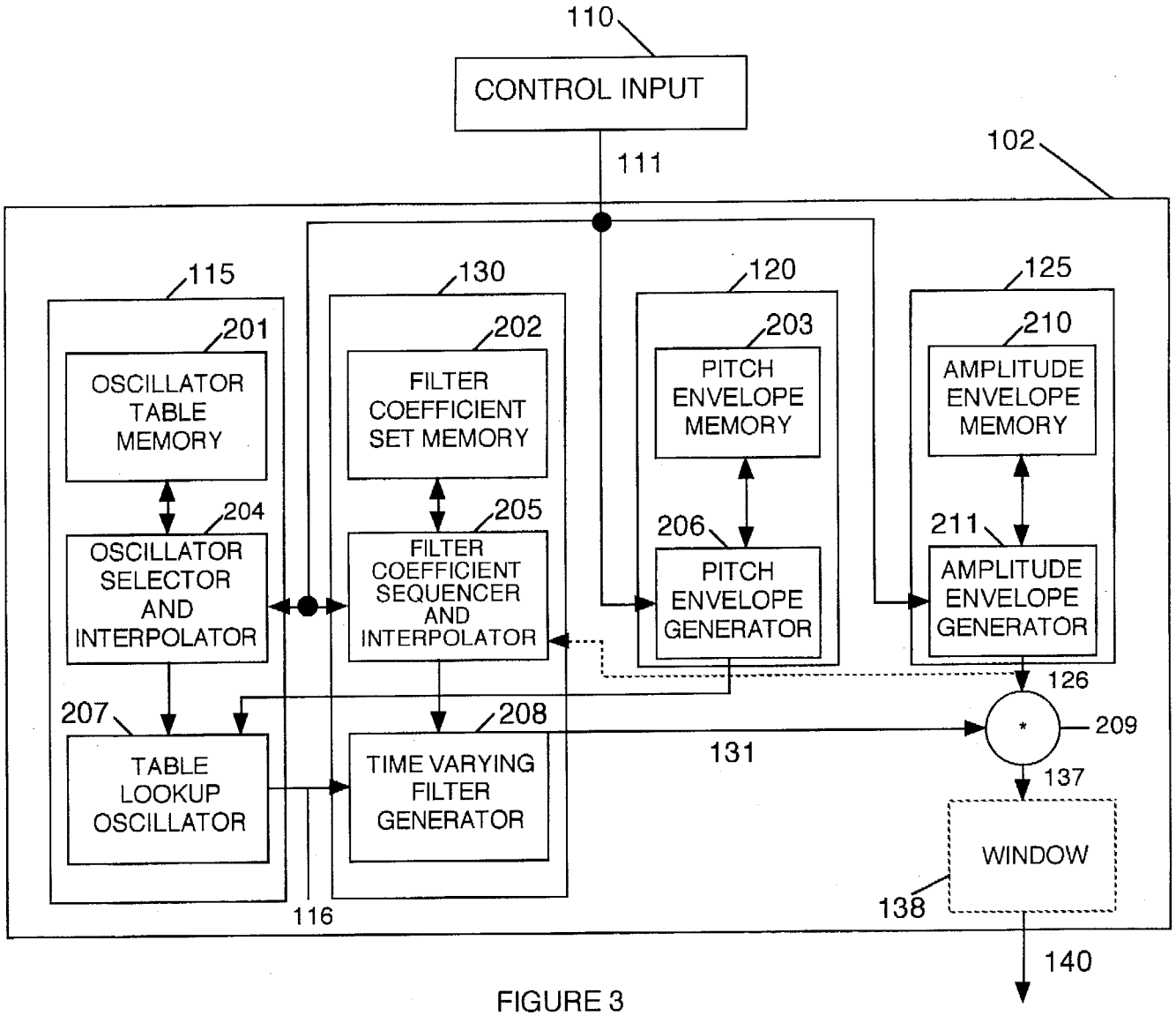
FIG. 3 shows a detailed block diagram of the pitched signal generator of FIG. 2.
Figure 4:
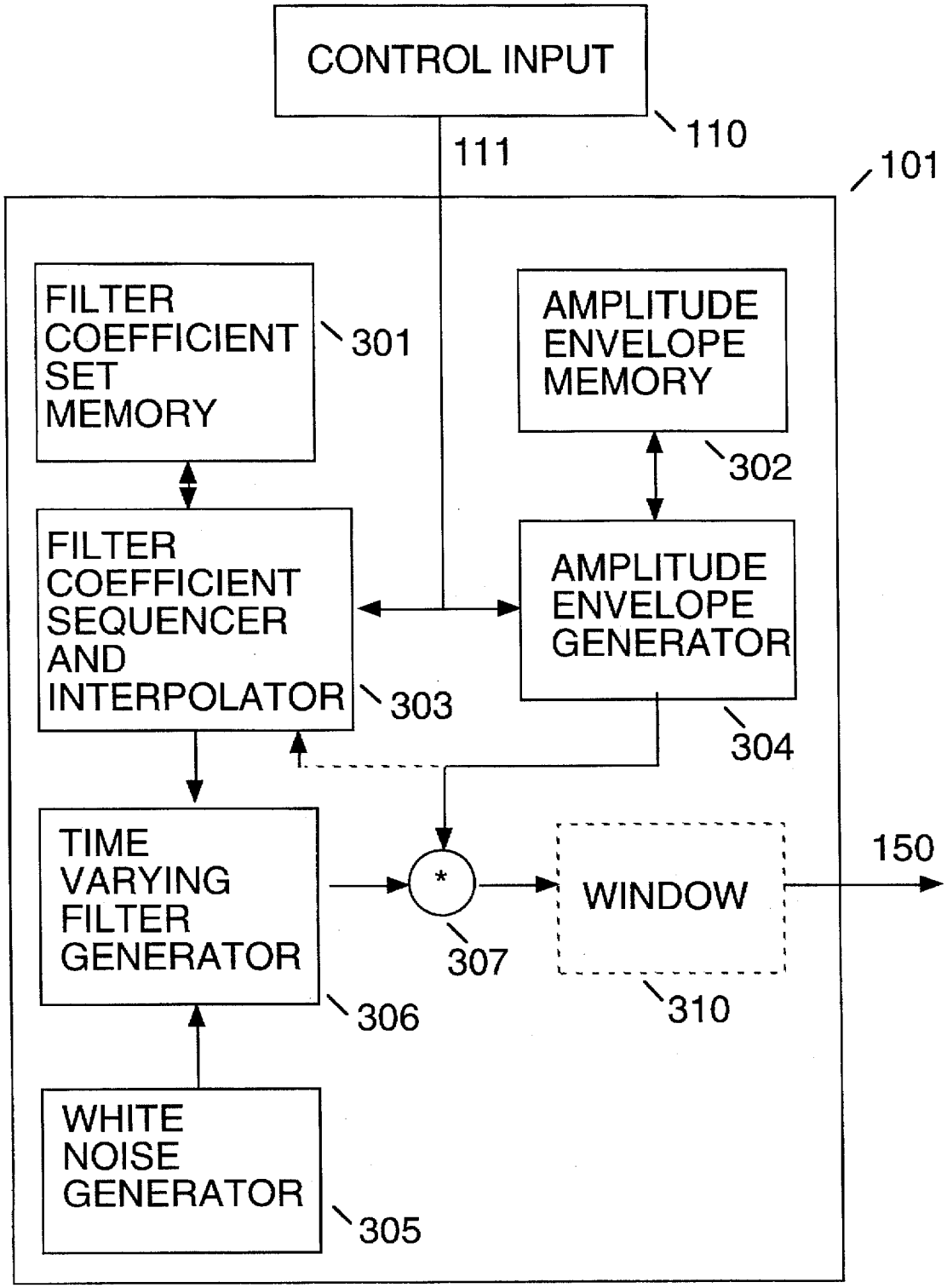
FIG. 4 shows a detailed block diagram of a first embodiment of the noise signal generator block of the parametric signal modeling music synthesizer of FIG. 1.
Figure 5:
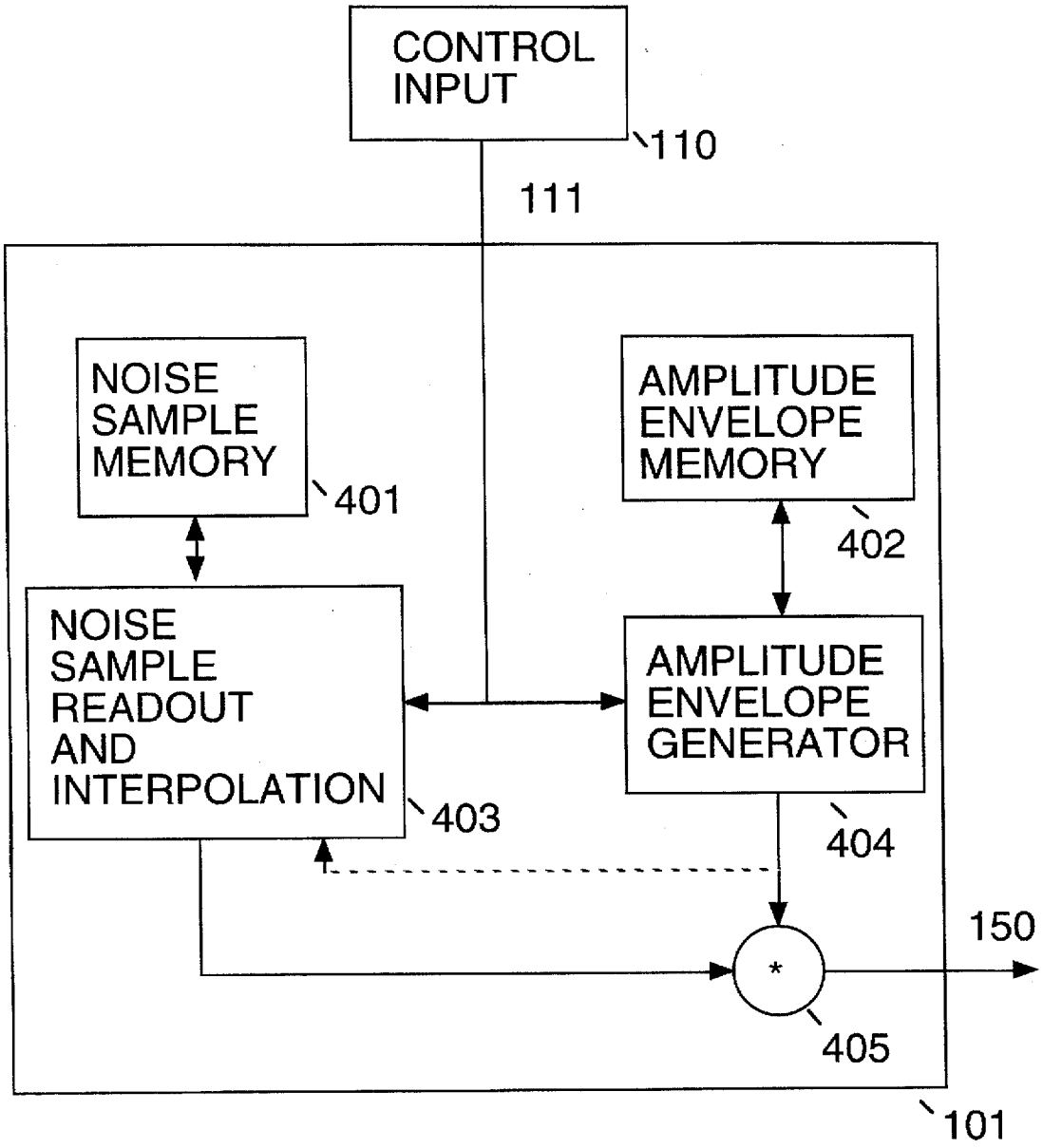
FIG. 5 shows a detailed block diagram of a second embodiment of the noise signal generator of the parametric signal modeling music synthesizer of FIG. 1.

FIGS. 2 and 3 show pitched signal generator 102 in more detail. FIGS. 4 and 5 show noise signal generator 101 in more detail.

FIG. 2 shows an intermediate level block diagram of pitched signal generator block 102 of the parametric signal modeling music synthesizer of FIG. 1. Control input 110 provides control signals 111, which control the instrument and pitch of the desired output tone 140. Control signals 111 may also control desired intensity. Intensity may be time varying during the duration of tone 140. Control signals 111 control excitation signal generator 115, pitch envelope generator 120, amplitude envelope builder 125, and formant filter generator 130.

The heart of pitched signal generator 102 is the combination of excitation signal generator 115 and formant filter generator 130. Excitation signal generator 115 generates an excitation signal 116 based upon the instrument and pitch specified by control signals 111. Formant filter generator 130 generates a formant filter which models the time varying frequency response of the instrument at the desired pitch (and perhaps time-varying intensity). Then, excitation signal 116 is filtered by the generated formant filter, resulting in a reasonably realistic intermediate tone 131. To enhance musical expressivity, pitch envelope builder 120 modifies the pitch of excitation signal 116 in a time varying manner, and amplitude envelope builder 125 generates an amplitude envelope which modifies intermediate tone 131, also in a time varying manner.

FIG. 3 shows a preferred embodiment of pitched signal generator 102 of FIG. 2. Excitation signal generator 115 comprises a stored, or downloaded multidimensional oscillator table memory 201, an oscillator selector and interpolator 204, and a table lookup oscillator 207. Table memory 201 is stored in the musical synthesizer. Oscillator selector and interpolator 204 accesses the desired portions of table memory 201 and interpolates across the data, providing a second, intermediate set of data for use by table lookup oscillator 207.

Formant filter generator 130 comprises a stored or downloaded multidimensional filter coefficient set memory 202, a filter coefficient sequencer and interpolator 205, and a time varying filter generator 208. Filter coefficient sequencer and interpolator 205 selects the appropriate portions of memory 202 for the desired note, and interpolates across the data to provide a temporary memory set for use by filter generator 208.

Pitch envelope builder 120 comprises a stored or downloaded multidimensional pitch envelope memory 203, and a pitch envelope generator 206. Amplitude envelope builder 125 comprises a stored or downloaded multidimensional amplitude envelope memory 210, and an amplitude envelope generator 211.

Excitation signal 116, comprising a periodic tone with a fixed harmonic structure determined at the onset of the note, is generated by table lookup oscillator 207. This periodic tone is filtered by a time-varying formant filter generated by filter generator 208. Filtered tone 131 has amplitude envelope 126 applied to it by multiplier 209. For a given instrument, the characteristics of the pitched signal generator 102 output 140 are determined by a desired pitch and intensity which are input to pitched signal generator 102 at the onset of the note. In one embodiment, the pitch and intensity are simple scalar values which are defined at the beginning of the note, and do not change over its duration. The stored or downloaded data elements (known as instrument parameter space in this application) involved in the synthesis of a tone by this embodiment of the pitched signal generator include:

1) The contents of table 201, used by table lookup oscillator 207.
2) The filter coefficient set memory 202, used by time varying filter generator 208.
3) Amplitude memory 210, used by amplitude envelope generator 211.
4) Pitch memory 203, used by pitch envelope generator 206.

At the onset of the tone, the appropriate portions of each of these stored data sets is selected for use by blocks 207, 208, 211, and 206. In the case of table lookup oscillator 207 and filter generator 208, intermediate data sets are formed in oscillator selector and interpolator 204 and filter coefficient sequencer and interpolator 205 by selecting and interpolating the appropriate portions of 201 and 202, respectively. These calculations are done as a function of the input pitch and intensity control variables.

Figure 6:
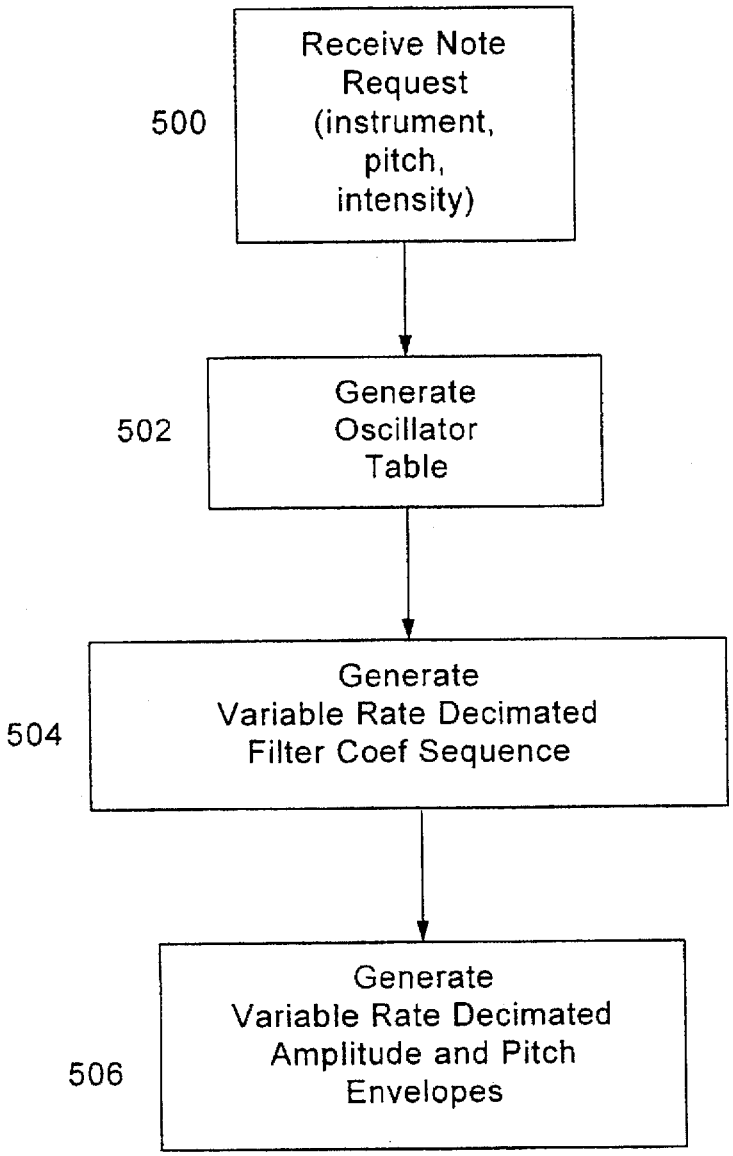
FIG. 6 is a flow diagram showing the note setup process for the pitched signal generator of FIG. 3, where the filter coefficient sequence is based upon initial pitch and intensity of the required note.

FIG. 6 shows the setup which occurs at the beginning of a note for the case where the filter coefficient sequence is determined based on initial pitch and intensity from control signals 111. In step 500, control signals 111 would typically include desired instrument, pitch and intensity. In step 502, an intermediate oscillator table is generated by oscillator selector and interpolator 204. In step 504, the variable rate decimated filter coefficient sequence to be used by time varying filter generator 208 is generated by filter coefficient sequencer and interpolator 205. Pitch envelope generator 206 and amplitude envelope generator 211 generate variable rate decimated amplitude and pitch envelopes from pitch memory 203 and amplitude memory 210, respectively. In this embodiment, amplitude envelope 126 is not an input to sequencer and interpolator 205, as shown by the dotted line in FIG. 3.

Thus, given an initial desired input pitch and intensity, oscillator selector and interpolator 204 interpolates between selected tables from multidimensional oscillator table memory 201 to produce a single oscillator table which is loaded into table lookup oscillator 207. Likewise, given the desired input pitch and intensity, the filter coefficient sequencer and interpolator 205 generates a sequence of filter coefficient sets based on interpolation of filter coefficient set sequences stored in the multidimensional filter coefficient set memory 202. The newly-generated filter coefficient set sequence is loaded into time varying filter generator 207. Finally, given the desired pitch and intensity, amplitude envelope generator 211 and pitch envelope generator 206 generate time-varying amplitude pitch envelopes based on amplitude and pitch envelope parameters stored in pitch envelope memory 203 and amplitude envelope memory 210. The following sections discuss in detail the operation of each of these components.

Oscillator Table Generation and Residual Excitation Synthesis for Pitched Signal Generation Excitation signal generator 115, (shown in FIG. 3) comprising blocks 201, 204, and 207, generates a tone of fixed harmonic structure by reading out and interpolating data. Oscillator selector and interpolator 204 selects the appropriate portion of memory 201 to read out according to the instrument, pitch and intensity of the desired tone, and interpolates the data to create a smooth intermediate table. The intermediate oscillator table holds a digitally sampled sequence representing exactly one pitch period of an excitation tone. Therefore, the contents of the intermediate table define the harmonic structure of the excitation tone. Table lookup oscillator 207 reads out data from this intermediate oscillator table in modulo fashion. That is, it reads from beginning to end of the table and then begins again at the beginning and continues reading. This continues for the duration of the tone.

In order to generate different pitches, table lookup oscillator 207 can read out data from the intermediate oscillator table at varying rates. The rate is determined by the desired pitch and the length of the table. The rate is represented by a fixed point phase increment value which has an integer and fractional part. The number of bits in the fractional part of the phase increment determines the frequency precision of the table oscillator. There is also a phase accumulator which holds the current fixed point—integer+fraction—offset in the table. In the simplest embodiment, the phase accumulator is initialized to zero and then for every output sample to be generated the phase increment is added to the phase accumulator, modulo the length of the table. The integer part of the new value in the phase accumulator is then used to form an offset address in the table. The value at this offset address is the new output sample.

This process of reading out samples at different rates is equivalent to sample rate conversion where:

New Sample Rate=Phase Increment * Original Sample Rate.

In music synthesis, no matter what the New Sample Rate is, the system will always output the sample stream at a predefined fixed sample rate, so the result of the sample rate conversion is really to change the pitch of the oscillator output stream, much as if we were slowing down or speeding up a tape or phonograph recording. The analogy to sample rate conversion is important because in sample rate conversion, we typically use an interpolation filter to generate an output stream from an input stream. In the embodiment cited above, where the output stream is determined by a single value table lookup from the integer part of the Phase Accumulator, the interpolation filter is equivalent to a "zero order hold" filter which is a very poor interpolation filter. The result will be undesirable aliasing components, that is spurious tones unrelated to the desired pitch. What's worse, in the case of time-varying pitch, these spurious tones may move in the opposite direction of the desired pitch. A higher order interpolation filter can suppress these aliasing tones, reducing them to an inaudible level. The higher order interpolation filter works by forming a linear combination of adjacent samples taken from a segment centered at the current phase accumulator offset. The fractional part of the phase accumulator is used to select a set of filter coefficients used in this linear combination. Rossum, U.S. Pat. No. and Rabiner and Crochiere . . . discuss in detail the properties of these kinds of interpolation filters.

As mentioned, the contents of the oscillator table determines the fixed harmonic structure of a periodic tone. This harmonic structure is then varied in a realtime dynamic manner by the time varying filter generator 208. The periodic tone represents a resynthesized residual excitation with the residual amplitude envelope factored out. The fixed harmonic structure of this periodic tone represents a kind of average or centroid harmonic structure of the residual excitation for the tone to be generated. Time varying filter generator 208 then provides the dynamic timbral variation of the spectrum. To avoid timbral discontinuities across the pitch and intensity space of the instrument, we would like the harmonic structure of the periodic tone to change smoothly as a function of input pitch and intensity. This is accomplished by oscillator selector and interpolator 204 which interpolates tables stored in oscillator table memory 201.

Several single pitch period tables are stored in oscillator table memory 201. These single pitch period tables are derived, for example, from the original residual excitation signals generated by the analysis of each recorded signal associated with the instrument. From each of the residual excitation signals, a single period table is derived. This derivation is really an extension of the analysis procedures described below under "Generation of Stored Tables", and is carried out as an off-line, "in the factory" process. In one embodiment, the derivation of the single period tables from the residual signals is accomplished in the following manner:

1) A general region of the excitation signal is specified as the search region for the single period.

The start point of this region is generally some delay—e.g., 250 milliseconds—after the attack portion of the tone so that the harmonic structure is relatively stable.

2) A pitch analysis is performed over this search region.

3) The search region is interpolated by an oversampling factor (e.g., 10).

4) Pairs of zero crossings are found in the interpolated region such that the interval between the zero crossings is as close as possible to (desired interval)=(1/pitch)* (oversampling factor), where pitch is determined by the pitch analysis.

5) The zero crossing pair closest to the desired interval defines the start and end of the selected single period. If there is more than one zero crossing pair equally close to the desired interval, then the pair nearest the start of the selected region is used.

6) The selected single period is resampled to a predefined normalized length (e.g., 256).

In another embodiment, the derivation of the single period loop is similar except that an attempt is made to find an average or centroid period over the selected region. This is done by selecting a number of zero crossing segments of equal length as defined by step 4) above, then taking the Fourier transform of each of these segments, and forcing all the phases of the different transformed segments to be identical—e.g., forcing them all to be equal to the first segment—and then averaging the segments. This produces a single period segment which is averaged over a selected region.

Using one of the approaches described above, a single period loop is derived from the residual excitation of each analyzed tone, where the set of tones analyzed covers the range of the instrument. For example, recorded tones from every octave of the instrument, and at three intensity levels might be used. Equal spacing in pitch is not required, although equal spacing in intensity is required for reasons described below. As mentioned, the resulting single period loops are resampled to a fixed normalized integer length. The length of the table determines the limits on bandwidth of the periodic tone. In other words, it determines the number of harmonics above the fundamental which can be generated. A 512 length table can support 256 harmonics so that a fundamental of 86 Hz can still have harmonics all the way up to the 22050 Hz Nyquist frequency of a 44100 Hz sampling rate system. In reality, tones with a low fundamental rarely have significant high frequency energy, meaning that a shorter length table—e.g., 256 or 128—is acceptable.

In one embodiment, all the single pitch period segments are normalized in length to the fixed table length—e.g., 256. Then, still in the off-line processing analysis phase, the Fourier transform of all the segments is taken, and then the phase response of all the segments is forced to be identical. For example, the Fourier transform phase response of all segments is forced to be equal to the phase response of the first segment. Or even better, all the Fourier transform phase responses are forced to a phase response which minimizes peakiness of the waveform. Forcing all the phase responses of the different segments to be identical is possible without audible distortion because these are exactly single pitch period waveforms with their harmonics centered exactly in the middle of the Fourier transform frequency bins with no overlap or interference between bins. Forcing the phases to be identical means that a linear combination of the single pitch period loops represents a linear combination, or interpolation, of the magnitude of the Fourier transforms of the segments. Thus, linear combining of the phased normalized loops interpolates between the harmonic spectra. If the phases were not equal, then linear combining would cause phase cancellations dependent on the phase relationships of corresponding Fourier transform bins for different loops which could cause dips in the harmonic spectrum as different loops are combined.

The various single period segments of normalized length and equalized phase are stored in multidimensional oscillator table memory 201. Each single period segment is associated with the pitch and intensity of the original recorded tone from which the single period was derived.

A tone is synthesized based on a desired pitch and intensity. The range of desired pitch and intensity describe a two dimensional pitch-intensity space. The entries in oscillator table memory 201, each of which is associated with a particular pitch and intensity, can be thought of as being associated with isolated points in this space. To generate a single period oscillator table for a particular realization of a tone of given desired pitch and intensity, that is, given a desired point in pitch-intensity space, oscillator selector and interpolator 204 searches for points in oscillator table memory 201 which surround the desired point in pitch-intensity space. The new single period oscillator table will then be generated by interpolating between the single period segments associated with these surrounding points. In one preferred embodiment, the oscillator selector and interpolator 204 searches for four surrounding points with:

a) pitch less than and intensity less than the desired point.

b) pitch greater than and intensity less than the desired point c) pitch less than and intensity greater than the desired point.

d) pitch greater than and intensity greater than the desired point.

As previously noted, the intensity dimension of the pitch-intensity space is uniformly sampled; that is, any pitch which is represented in the memory is represented with the same number and selection of intensities. This being the case, the interpolation between the four surrounding points is well defined. The four points surrounding the desired point form a rectangle in pitch-intensity space with the desired point somewhere in the interior of the rectangle. The four segments corresponding to the four surrounding points are linearly combined using weights inversely proportional to the distance of the desired point from each surrounding point. Four weights are needed corresponding to the four surrounding points. To compute these weights the following two quantities are defined:

pitch_distance=(pitch(p)−pitch(a))/(pitch(b)−pitch(a))

db_distance=(db(p)−db(a))/(db(d)−db(a))

where:

a,b,c,d=the four surrounding points as described above.

p=the desired point pitch(x)=pitch of point x db(x)=log intensity in decibels of point x then the four weights are:

wa=(1-pitch_distance) * (1-db_distance)

wb=pitch-distance * (1-db_distance)

wc=(1-pitch_distance) * (amp_distance)

wd=(pitch_distance)*(amp_distance)

where wx is the weight of surrounding point x. The weights are guaranteed to sum to 1.

Figure 13:
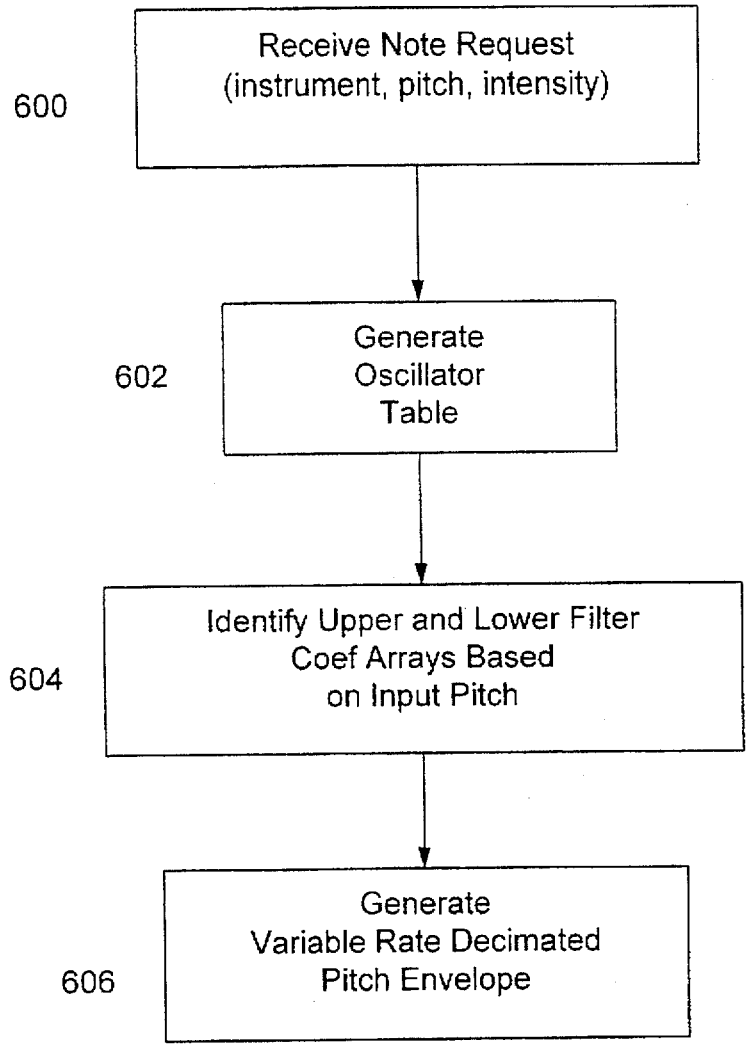
FIG. 13 is a flow diagram showing the note setup process for the pitched signal generator of FIG. 3, where the filter coefficient sequence is based upon initial pitch and time-varying intensity.

The newly-interpolated oscillator table is used by table lookup oscillator 207 to generate a residual excitation tone of the desired pitch and fixed harmonic spectrum, with possible small variations in pitch over time due to pitch envelope 121. The same table is used for the entire duration of the synthesized tone. In preparation for the synthesis of a musical tone, a set of calculations are executed which are collectively called Note Setup. Note Setup for two embodiments of the present invention are shown in FIGS. 6 and 13. These calculations occur one time before playing any note of a given instrument. This distinguishes Note Setup calculations from Real Time Synthesis calculations which occur throughout the duration of the tone. In one embodiment, the generation of a new oscillator table is included in the Note Setup calculations. In this case, the table is generated once, and then stored in RAM where it is looped over again and again for the duration of the tone. In another embodiment, the interpolation calculations are included as part of the Real Time Synthesis calculations. That is, the interpolated oscillator table is generated over and over again throughout the duration of the note from the surrounding segments in oscillator table memory 201. The advantage of the first approach is that the table is generated only one time so that computation is minimized. The disadvantage of the first approach is that the table, once computed, must be stored in RAM. If there are a large number—e.g., 32—of tones playing simultaneously, then the RAM must be big enough to accommodate all tables. The second approach does not require this table storage RAM but requires more ongoing real-time computation.

The embodiments described above interpolate between four surrounding points in two dimensional pitch-intensity space. In another simplified embodiment, the intensity dimension is removed. Oscillator table memory 201 becomes one dimensional in pitch only. The interpolation of a new table is then between two surrounding pitch points. Since this interpolation requires less calculation, than the four point interpolation, it is well suited to the on-the-fly continual recalculation of the oscillator table. The justification for the reduction to a single pitch dimension is that practical experience has shown that the spectrum of the single period residual segments is more sensitive to changes over pitch than over intensity. Said another way, it is possible to capture the changes of timbre with respect to intensity by appropriate changes of time-varying filter coefficients keeping the residual excitation constant. It is more difficult to remove the dependency of the residual segment on pitch, at least with a reasonably low order filter.

Figure 7:
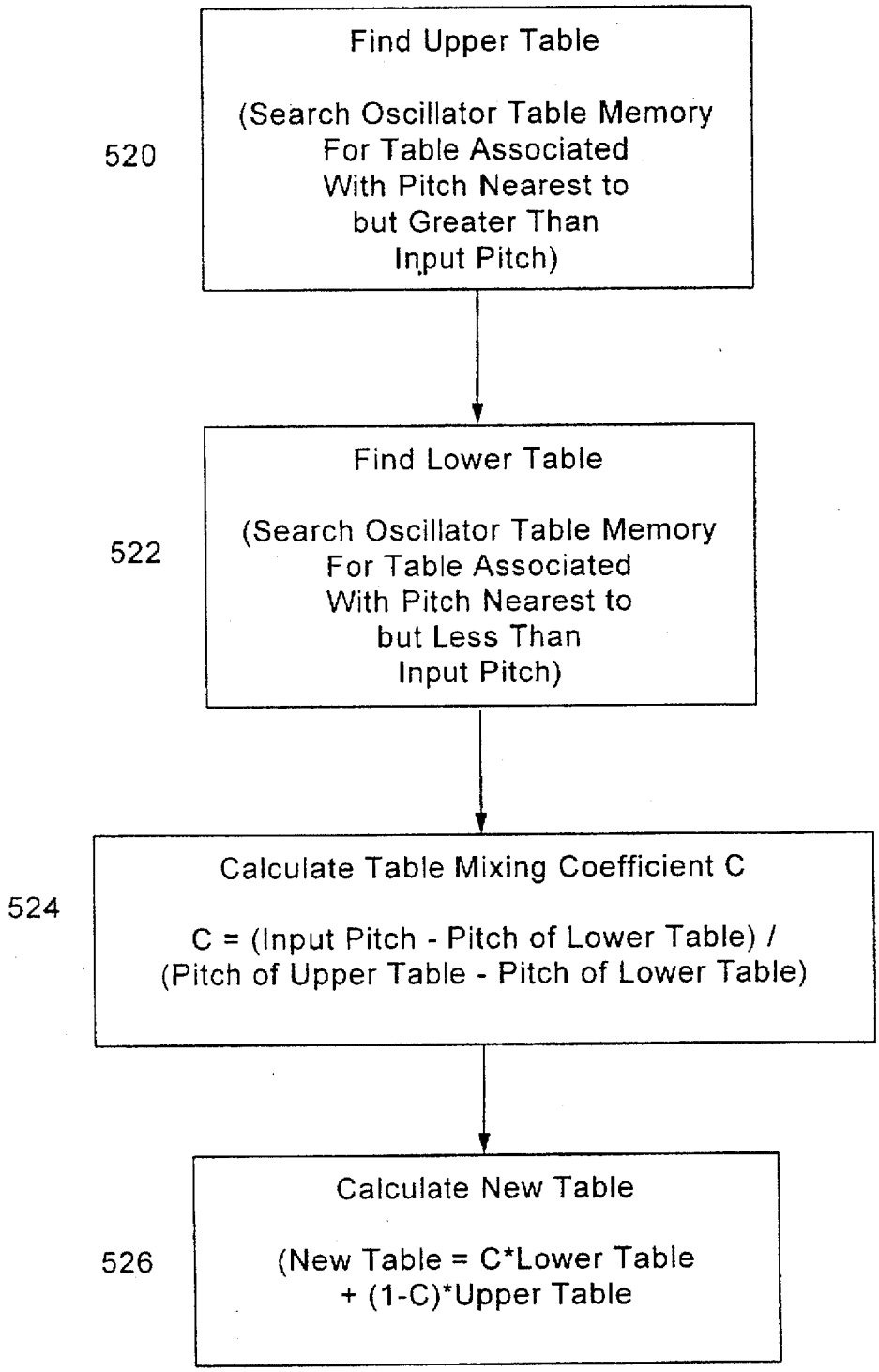
FIG. 7 is a flow diagram showing the process of generating the variable rate decimated filter coefficient sequence during the note setup process of FIG. 6.

FIG. 7 is a flow diagram showing the process accomplished by oscillator selector and interpolator 204 to generate the intermediate oscillator table used by table lookup oscillator 207, based upon initial pitch only. FIG. 7 corresponds to block 502 in FIG. 6. Step 520 finds the table in memory 201 associated with the pitch nearest to the pitch requested by control signals 111, but higher than the requested pitch. Step 522 finds the table associated with the nearest pitch lower than the requested pitch. Step 522 calculates a table mixing coefficient C, and step 526 computes the new, interpolated table for use by table lookup oscillator 207, where:

C=(input pitch-pitch of lower table)/(pitch of upper table-pitch of lower table)

New Table=C* Lower Table+(1-C)*Upper Table

In the embodiments described above, all the single period segments stored in the Multidimensional Oscillator Table Memory are normalized to the same length. This makes linear combination of tables simple. For higher pitches, however, which do not require as many harmonics, this is clearly wasteful of memory space. In another embodiment, table lengths are constrained to be integer multiples of smaller table lengths with the smaller table lengths corresponding to residuals derived from higher pitched tones. For example, with tones sampled at every octave, table lengths might be 512, 256, 128, 64, 32, etc. In this case, each table is oversampled in frequency by a factor of two. This means that the table can be simply decimated by a factor of two by taking every other point without introducing aliasing artifacts. Since, in the one dimensional case, only segments from two adjacent frequency points are combined for interpolation—e.g., two adjacent octaves—then to combine the table of length 128 with the table of length 64, the 128 length table is simply decimated to 64 and the combination is carried out. Likewise, to combine the 64 length table with the 32 length table, the 64 length table is simply decimated to 32 before combining. It is clear that the 512 length table listed above will always be combined with the 256 length table, so it will always be decimated to 256, meaning that the real set of table lengths should be 256, 256, 128, 64, 32 etc., with the first 256 length table critically sampled and all other tables oversampled by a factor of two.

In the description above, there are always surrounding points in pitch-intensity space for any desired input pitch and amplitude. In practice, pitch-intensity points may be requested which lie beyond the maximum and minimum points represented in oscillator table memory 201. In this case, the new oscillator table is derived from oscillator table memory 201 either by taking the maximum or minimum entry in the memory or by extrapolating beyond the end of the memory by extending the slope implied by the last two or more entries in the memory. In this way, there need be no restriction on desired pitch-intensity points. The resulting oscillator table will simply be less realistic as the desired points range beyond those represented in the memory.

In another optional mode of operation, table lookup oscillator 207 receives and is responsive to a time-varying pitch envelope 121 generated by pitch envelope generator 206. While the harmonic structure is fixed, the pitch can vary, usually by small amounts, as one would find in the vibrato or random pitch variations associated with a wind or string instrument. A detailed discussion of amplitude and pitch envelope generation is presented below.

Time-Varying Filtering for Pitched Signal Generation

The excitation signal generator blocks 201, 204, and 207 of the pitched signal generator 140 shown in FIG. 3 generate an excitation signal 116 of fixed harmonic spectrum which lasts the duration of the synthesized tone. Time varying filter generator 208 of FIG. 3 filters this excitation signal 116 to provide a realistic, dynamically changing spectrum. Pitched signal generator 140, shown in FIG. 3, has two modes of operation. In the first mode, the sequencing of time-varying filter coefficient sets is entirely controlled by filter coefficient sequencer and interpolator 205. In the second mode, the sequencing of time-varying filter coefficients is generated in response to a time-varying amplitude envelope generated by amplitude envelope generator 211. The first mode of operation is discussed first.

The result of parametric analysis of the pitched part of a recorded tone of a particular pitch and intensity is a residual excitation signal, a sequence of filter coefficients sets, a time-varying pitch envelope, a time-varying amplitude envelope, and an attack envelope. Each filter coefficient set describes the spectrum of the recorded signal over the period of one windowed analysis frame. If the original residual excitation is filtered by a time-varying filter which uses exactly the filter coefficients derived from parametric signal modeling, then the resultant resynthesized tone is perceptually identical to the original. However, a prohibitive amount of device memory would be required to store the full set of filter coefficients. The resynthesis described in this disclosure departs from this model in a number of ways, in order to reduce the amount of memory required:

1) The residual excitation 116 which drives filter generator 208 is based on a single period looping oscillator.
2) A sequence of filter coefficient sets are derived from a much reduced selection of filter coefficient sets taken from the original sequence and stored in memory 202. These sets are interpolated over time by filter coefficient sequencer and interpolator 205 to simulate the original sequence.
3) Sequences of filter coefficient sets are stored only for a selected number of pitches and intensities. To resynthesize a tone at an arbitrary pitch and intensity, a sequence of filter coefficient sets is derived by interpolating between the appropriate stored sequences of filter coefficient sets.
4) A time-varying amplitude envelope 126 is applied after the time varying filter generated by filter generator 208 to compensate for the lack of amplitude variation in the oscillator based excitation 116. The generation of this amplitude envelope by amplitude envelope generator 211 is especially designed to preserve detail in the attack section of the resynthesized tone.

In this section, we will discuss in detail the derivation and interpolation of sequences of filter coefficient sets. In the first mode of operation of the embodiment of FIG. 3, filter coefficient sequencer and interpolator 205 derives a sequence of filter coefficient sets based on an input pitch and intensity. This pitch and intensity are stable over the duration of the tone. Sequencer and interpolator 205 performs this derivation based on filter coefficient set sequences found in multidimensional filter coefficient set memory 202. Memory 202 holds decimated versions of the sequences of filter coefficient sets associated with the original recorded tones. The process of decimation involves simply removing large numbers of filter coefficients from the sequence. For example, taking every tenth filter coefficient set from a sequence corresponds to decimating the sequence by ten. For the decimated sequences stored in memory 202, a variable decimation rate is used. This permits regions of the signal which have rapid changes in timbre to be decimated less than regions of the signal where the timbre is relatively stable. A typical decimated sequence, for example, one associated with a trumpet tone, might take the frames from the first 150 milliseconds of the sequence undecimated followed by two coefficient sets per second over the sustain region of the tone, followed by 5 coefficient sets per second during the release portion of the tone. An approximation of the original undecimated sequence of coefficient sets can be generated by variable rate interpolation between coefficient sets of the decimated sequence.

Filter coefficient set memory 202 holds decimated versions of the filter coefficient set sequences associated with a number of recorded tones of different pitches and intensities. Just as in the case of oscillator table memory 201, these filter coefficient set sequences can be thought of as being associated with a point in pitch-intensity space. To generate a new sequence associated with a desired point in pitch-intensity space, filter coefficient sequencer and interpolator 205 interpolates between filter coefficient set sequences which are associated with points in pitch-intensity space which surround the desired point. Just as in the case of table memory 201, the sampling over pitch can be arbitrarily spaced but for every pitch represented in memory 202 there is the same set of intensity levels represented—e.g., soft, medium, loud. This simplifies the interpolation process.

Thus, filter coefficient sets are interpolated in two ways. First, a new decimated filter coefficient set sequence is derived by interpolation in pitch-intensity space from decimated sequences stored in filter coefficient set memory 202. Then the newly-generated decimated filter coefficient set sequence is interpolated over time to generate a new undecimated sequence.

In the description above, there are always surrounding points in pitch-intensity space for any desired pitch-intensity. In practice, as in the case of table memory 201, pitch-intensity points may be requested which lie beyond the maximum and minimum points represented in filter coefficient set memory 202. In this case, the new decimated filter coefficient set sequence is derived from filter coefficient set memory 202 either by taking the maximum, or minimum, entry in the memory or by extrapolating beyond the end of the memory by extending the slope implied by the last two or more entries in the memory. As in the oscillator table 201 case, there need be no restriction on desired pitch-intensity points.

There are some special issues related to the general problem of interpolating filter coefficients. In the approach to analysis described above, the filter coefficients are in the form of coefficients of an Nth order polynomial. In general, interpolation between coefficients of different high order polynomials can produce intermediate coefficient sets which are poorly behaved, unstable, etc. A better approach is to convert from the polynomial filter coefficient representation to a representation involving reflection coefficients—see *Multirate Digital Signal Processing,* Crochiere et. al, Prentice-Hall 1983. Interpolation of reflection coefficients is better behaved, guaranteed stable, and generally produces intermediate filters which perceptually sound more like they are "in between" the timbres of the filter coefficient sets being interpolated. Another approach to filter coefficient set interpolation is to convert from the polynomial coefficient representation to a pole-zero representation. Then the angles and magnitudes of poles can be directly interpolated. This approach is more computationally costly then the reflection coefficient case. It can be seen by one versed in the art that a number of coefficient interpolation techniques can be applied to the problem without significantly altering the nature of this invention.

The generation of four weighting parameters associated with interpolation of filter coefficients in pitch-intensity space is identical to the generation of the four weighting parameters associated with the interpolation of oscillator table 201 data described above. So the newly-derived decimated filter coefficient set sequence is a weighted linear combination of four surrounding coefficient set sequences stored in memory 202 where the weighting is determined by the distance of the desired point in pitch intensity space from the four surrounding points.

Linear interpolation between filter coefficient sets always involves making a weighted linear combination of coefficient sets. All the coefficient sets must have the same number of coefficients. In this process each coefficient set is assigned a scalar weighting value and each coefficient in the set is multiplied by this scalar weighting value. Then the coefficient sets are summed by adding together corresponding weighted coefficients in the sets. The result is a single coefficient set with the same number of coefficients as the sets being combined. Interpolation between coefficient set sequences involves interpolating between corresponding coefficient sets in the sequences. This implies that the coefficient set sequences must have the same number of sets. The decimated coefficient set sequences stored in filter coefficient set memory 202 all share the same variable decimation rate and contain the same number of coefficient sets. This means that the Nth coefficient set in every decimated coefficient set sequence in memory 202 will always refer to the same time offset relative to the onset of the tone. This makes interpolation between coefficient set sequences tractable.

Figure 8:
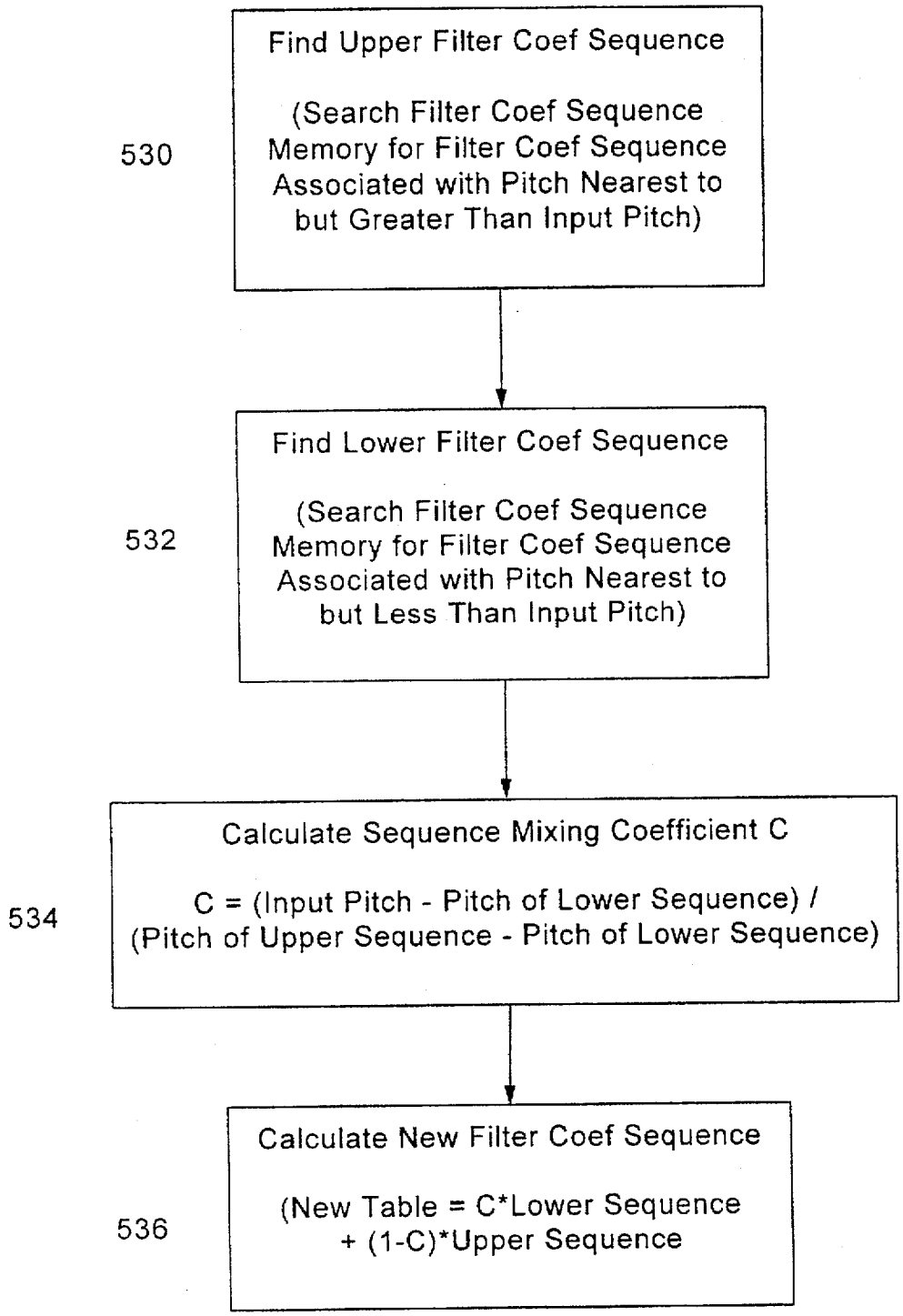
FIG. 8 is a flow diagram showing the process of generating the intermediate oscillator table during the note setup process of FIG. 6.

FIG. 8 shows how this initial interpolation of filter coefficient sets is accomplished by oscillator selector and interpolator 204 based only upon initial pitch. FIG. 8 corresponds to step 504 in FIG. 6. Step 530 finds the filter coefficient sequence corresponding to the pitch nearest to the input pitch, but above the input pitch. Step 532 finds the nearest lower sequence. Step 534 calculates sequence mixing coefficient C, and step 536 calculates the new filter sequence based upon C, where:

C=(input pitch- lower sequence pitch)/(upper sequence pitch-lower sequence pitch)

New table=C*lower sequence+(1-C)*upper sequence

The newly-interpolated decimated filter coefficient set sequence is further interpolated over time by interpolating between adjacent sets of the decimated sequence. Enough new sets are generated between adjacent sets so that the original points in the decimated sequence align in time with the original undecimated sequence from which they were selected.

In the embodiment described above, decimated filter coefficient set sequences are interpolated to generate an approximation of an original undecimated sequence, or one lying between surrounding points in pitch-intensity space. This is appropriate for certain "deterministic" tones such as piano, vibraphone, etc. For these instruments, a tone of a given pitch and intensity follows a fairly deterministic timbral evolution. For other instruments, such as trumpet and violin which are subject to dynamic control over the duration of a tone, the timbral evolution is less deterministic. For example, the sustain of a trumpet or violin tone is arbitrarily long. Therefore, it cannot be represented as a sampled sequence of finite length. One method of treating this problem is to perform looping in the filter coefficient set sequence just as looping is performed in traditional wavetable synthesis. Looping filter coefficient sets has certain advantages since it is possible to interpolate between the start and end of a loop without introducing the undesirable phase cancellation artifacts associated with crossfade looping. However, as in the case of wavetable synthesis, looping over filter coefficient set sequences can lead to undesirable mechanical periodicities. One remedy for this problem is to perform a random walk through a filter coefficient set sequence. In the random walk, we move forward and backward through the sequence in random intervals—e.g., forward 3 frames, back 2, forward 9, back 4, etc. An important parameter associated with the random walk is the variance of the interval length taken before a change of direction.

The second mode of operation of the embodiment of FIG. 3 provides another solution to the nondeterministic sequence generation problem. In this mode, filter coefficient set memory 202 contains sequences which are divided into sections corresponding to attack, sustain, and release. The attack and release sections are similar in structure to the decimated sequences described in the embodiment of FIG. 3. They represent a decimated in time—sometimes even undecimated—representation of the original time sequence of coefficient sets. In the sustain region, a different approach is taken. In this region, filter coefficient sets do not represent a time sequence but are, instead, organized by amplitude levels. The amplitude levels referred to here are the levels of the time-varying amplitude envelope 126 which is derived from the analysis of the original tone. To generate the contents of the sustain region of memory 202, the amplitude envelope for the sustain region of the analyzed tone is partitioned into a certain number of discrete amplitude levels. The filter coefficient set for a given frame is associated with the discrete amplitude level which is nearest the amplitude envelope value for that frame. This gives rise to a many-to-one mapping of filter coefficient sets to discrete amplitude levels. Once this many-to-one mapping is complete, then the filter coefficient sets associated with a particular discrete amplitude level are averaged to generate a single filter coefficient set. This results in a one to one mapping of amplitude levels to coefficient sets. This forms a kind of Vector Quantized (VQ) codebook of filter coefficient sets indexed by amplitude level. We will refer to this as the sustain codebook associated with a particular tone.

In this mode of operation, there is a sustain codebook associated with every pitch represented in filter coefficient set memory 202, but tones of the same pitch and different intensities share the same codebook. It will be seen by those skilled in the art that the particular organization of memory 202 is less important than the general concept of indexing filter coefficient sets by time-varying amplitude.

Many different digital filter structures can be used in the context of the current invention. Some possible digital filters are direct form I and II filters, cascade second order sections, lattice, and ladder filters. In the examples discussed in this disclosure, the particular Parametric Signal Modeling employed is AR all pole analysis, although ARMA pole-zero modeling, and MA all-zero modeling are also possible. As mentioned, the filter coefficients are most easily interpolated using a reflection coefficient representation. This lends itself naturally to a lattice filter implementation. The disadvantage of this implementation is the higher computational cost associated with lattice filters, as opposed to direct form or cascade structures. It will be seen by one skilled in the art that the particular choice of filter structure or interpolation strategy does not fundamentally alter the nature of the invention.

Another important issue associated with filter coefficient interpolation is the frequency with which filter coefficients are updated. Two embodiments relating to this problem are described. In the first embodiment, the time-varying filter runs on a sample by sample basis and the filter coefficients are gradually changed while the filter is running. The rate of update of the filter coefficients in this case is dependent on the rate of change of the filter coefficients. One coefficient set update every two to four samples is typical. This update rate is important because every coefficient set update involves an interpolation operation performed on every coefficient in the set. Coefficient sets with 10 to 20 coefficients are typical. It can be seen in this case that filter coefficient update may be more costly than basic filter operation.

Figure 12:
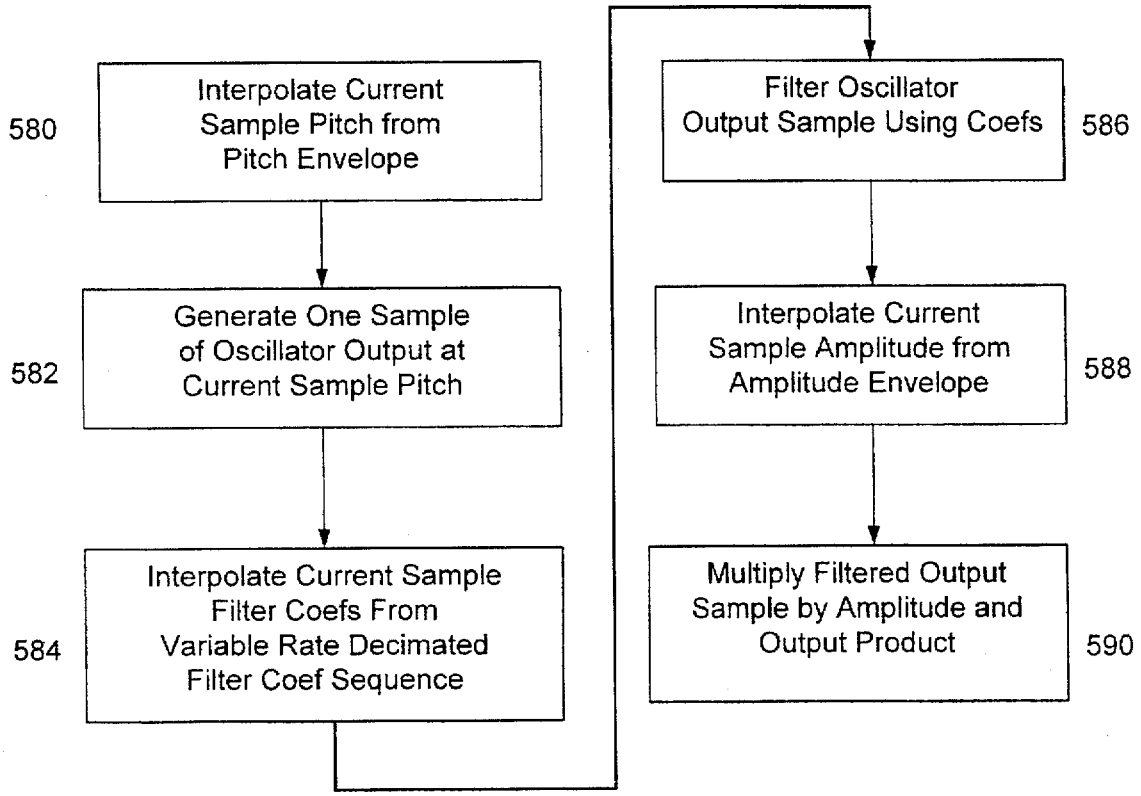
FIG. 12 is a flow diagram showing the sample by sample pitched signal smoothing process for the FIG. 3 pitched signal generator based upon initial pitch and intensity.
Figure 18:
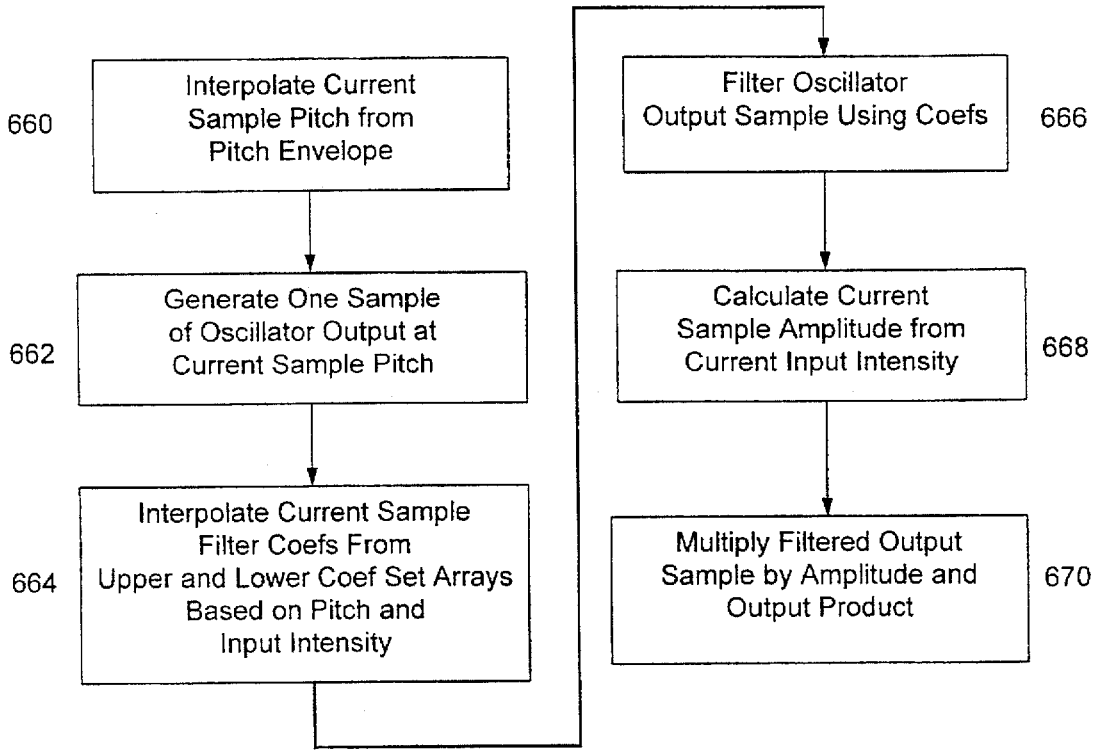
FIG. 18 is a flow diagram showing the sample by sample pitched signal smoothing process for the FIG. 3 pitched signal generator based upon initial pitch and time-varying input intensity.

FIG. 12 shows the sample by sample process of coefficient updating based upon initial intensity and pitch. Pitch envelope generator 206 interpolates current sample pitch from the pitch envelope in step 580. Table lookup oscillator 207 generates one sample of oscillator output at current sample pitch in step 582. Time varying filter generator 208 interpolates current sample filter coefficients from the variable rate decimated filter coefficient sequence in step 584, and filters the oscillator output sample using the sequence in step 586. In step 588, amplitude envelope generator interpolates the current sample envelope from the amplitude envelope. Multiplier 209 multiplies the filtered sample output by the amplitude, and outputs the product as output 140. Dotted window 138 is not included in this embodiment. The sample-by-sample process of updating coefficients may also be used in the environment wherein time-varying intensity is an input to filter coefficient sequencer and interpolator 205, as shown in FIG. 18.

In the second embodiment of coefficient updating, the time-varying filter runs in a frame-by-frame windowed mode. For every coefficient set update, the filter generates one output frame, similar or identical in size to the original analysis frames. The output frames are windowed using any number of tapered window functions—e.g., hanning window. Successive frames are overlap added—a 2 to 1 overlap is typical. The advantage of this embodiment is that filter coefficients are updated once per frame and the overlap and tapering of the windowed frames provide implicit coefficient interpolation frame to frame.

Figure 11:
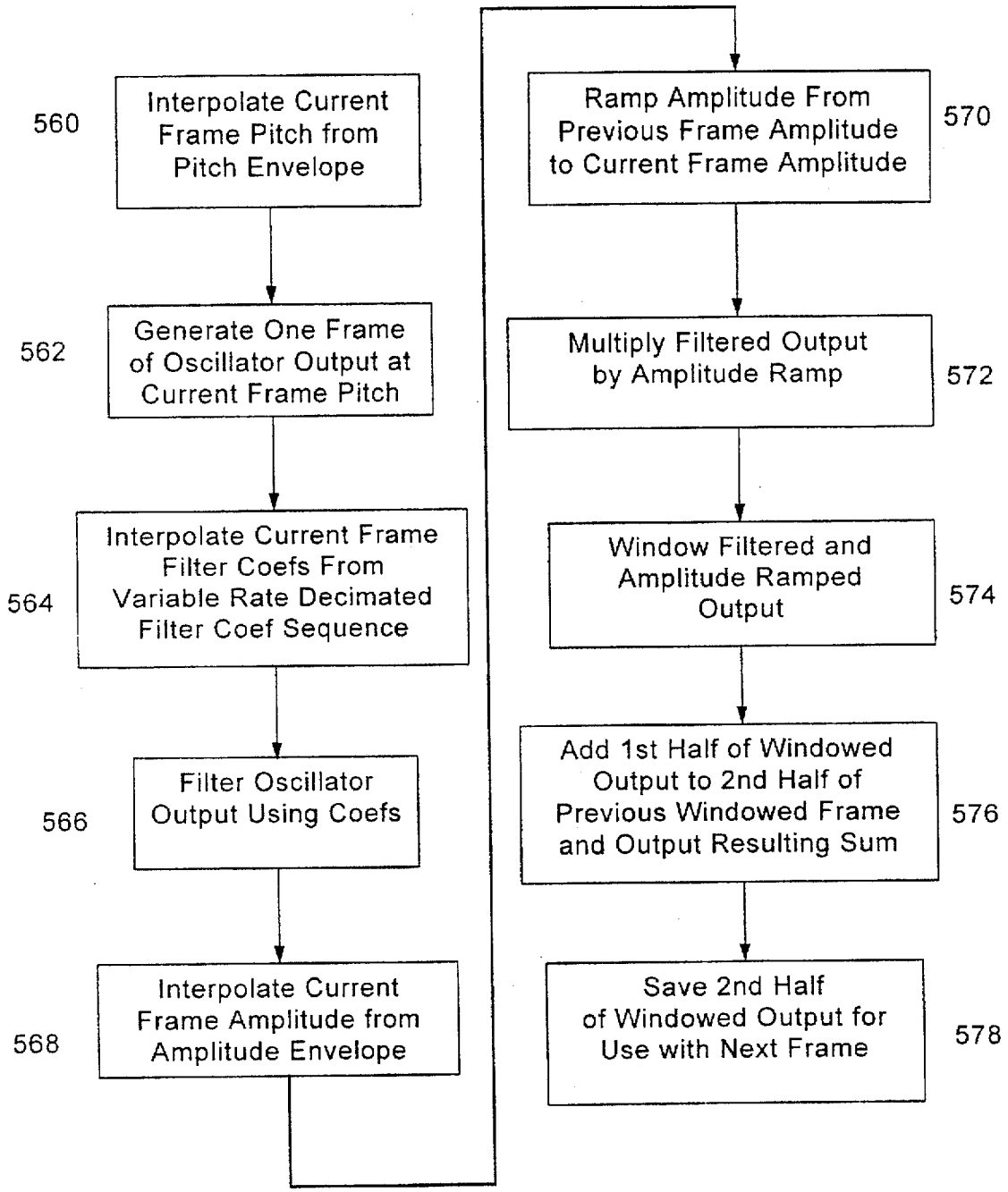
FIG. 11 is a flow diagram showing the frame by frame, or windowed, pitched signal smoothing process for the FIG. 3 pitched signal generator based upon initial pitch and intensity.
Figure 15:
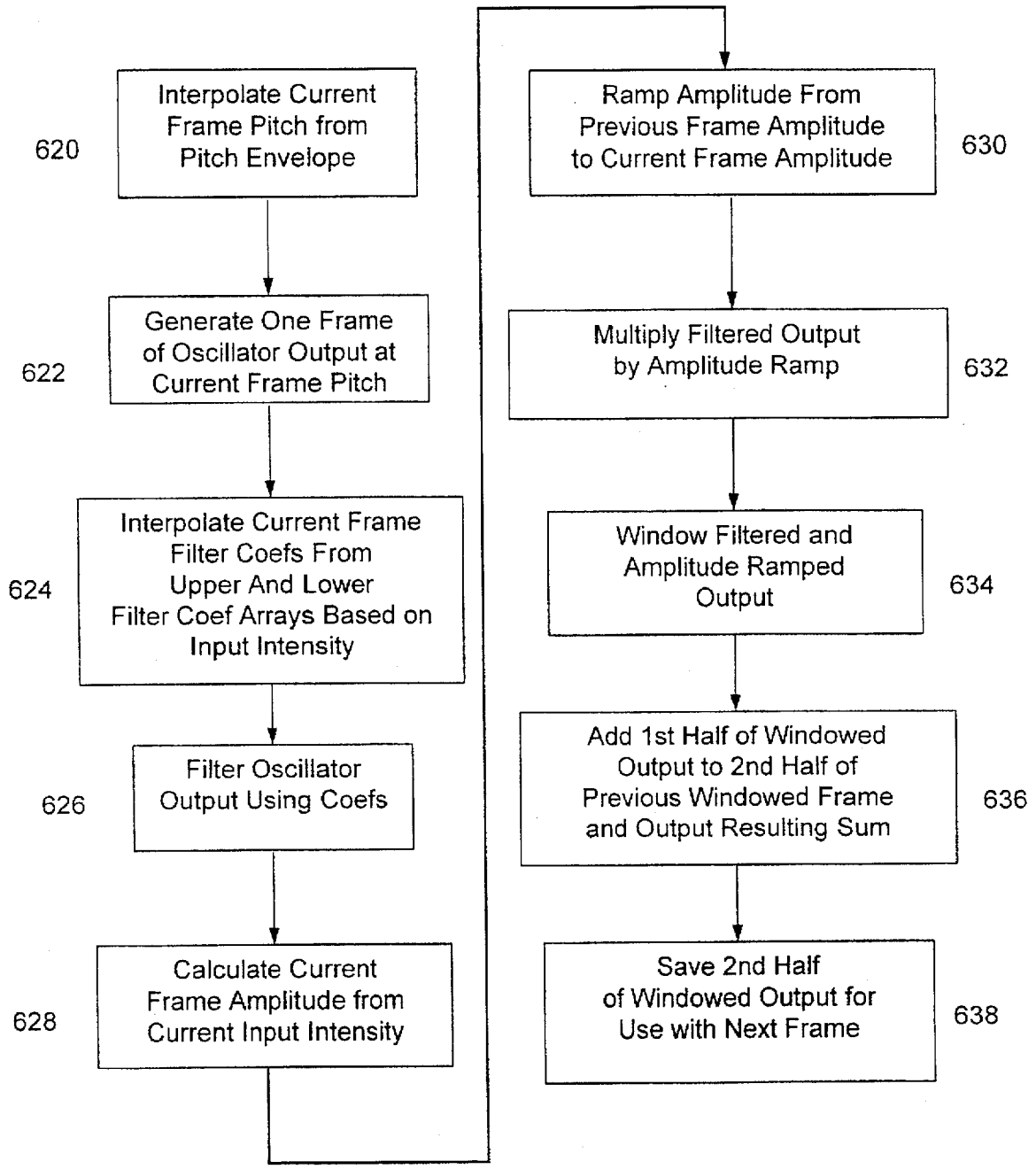
FIG. 15 is a flow diagram showing the frame by frame filter pitched signal smoothing process for the FIG. 3 pitched signal generator based upon initial pitch and time-varying intensity.
Figure 16:
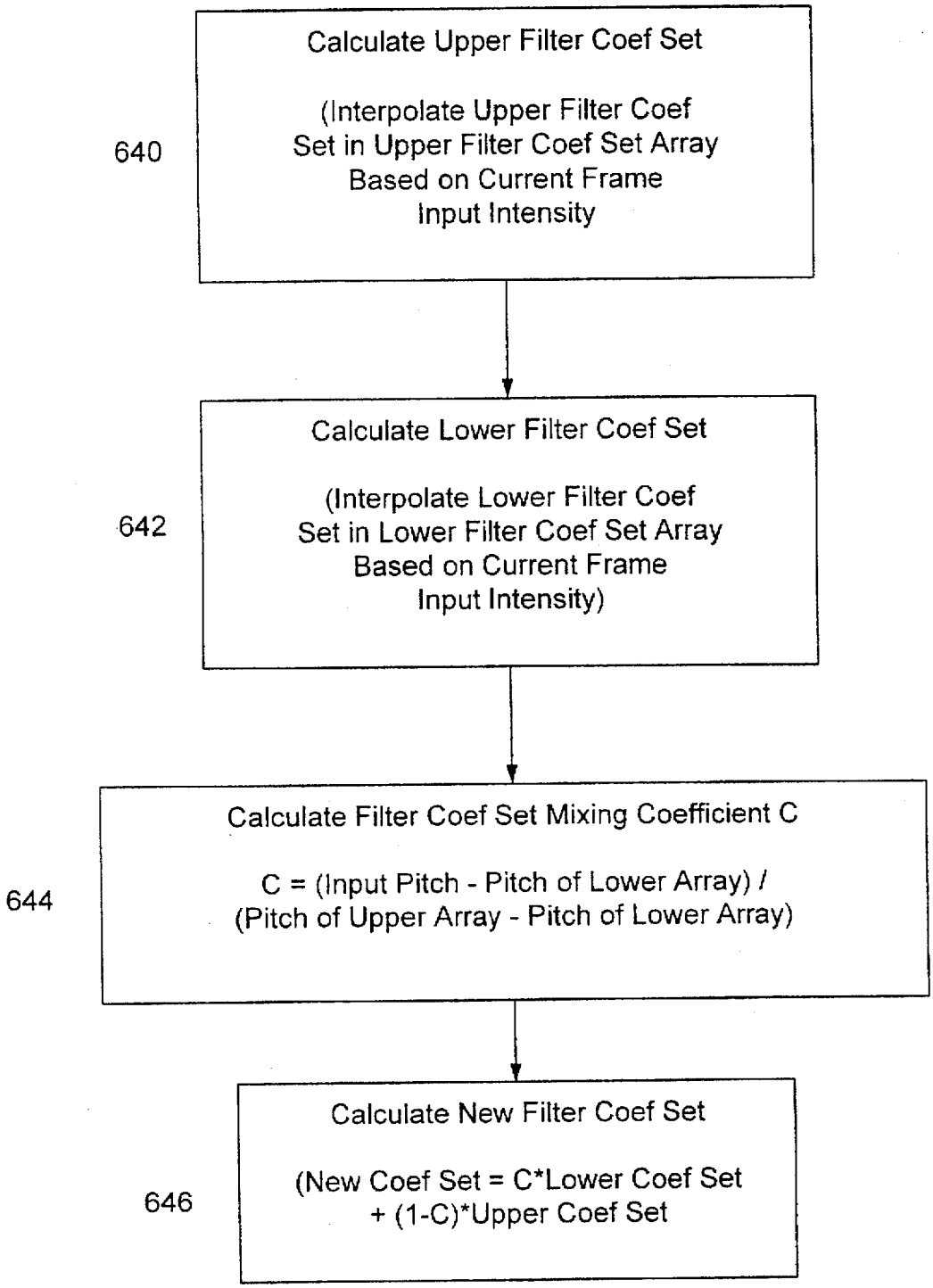
FIG. 16 is a flow diagram showing the process of interpolating current frame filter coefficients from upper and lower filter coefficient arrays based on current input intensity during the frame by frame updating process of FIG. 15.

FIG. 11 shows the frame by frame, or windowed, coefficient updating embodiment, based upon initial pitch and intensity. In step 560, the current pitch is determined from pitch envelope 121. In step 562, table lookup oscillator 207 generates a frame of oscillator output for the current pitch. In step 564, time varying filter generator 208 finds the current frame filter coefficients by interpolating the variable rate decimated filter coefficient sequence. In step 566, filter generator 208 filters the oscillator output using the current frame coefficients. Amplitude envelope generator 211 interpolates the current frame amplitude envelope from the newest decimated amplitude envelope in step 568. In step 570, amplitude envelope generator 211 ramps between the previous frame amplitude and the current frame amplitude. Multiplier 209 multiplies filtered output 131 by amplitude envelope 126. Window 138 (shown as a dotted box in FIG. 3) windows the filtered and amplitude enveloped output 137 in step 574, adding the first half of the current windowed output to the second half of the previous frame, and outputting the sum as output 140. In step 578, window 138 saves the second half of the current windowed output for use with the next frame. The frame by frame process of updating coefficients may also be used in the environment wherein time-varying intensity is an input to filter coefficient sequencer and interpolator 205, as shown in FIGS. 15, 16, and 18.

In a second mode of operation, a time-varying intensity signal is used by filter coefficient sequencer and interpolator 205 to generate a sequence of coefficient sets. This time-varying intensity signal may be part of input control signals 111, or may be a time decimated version of amplitude envelope 126 passed to filter coefficient sequencer and interpolator 205 (shown as a dotted line in FIG. 3). Filter coefficient sequencer and interpolator 205 uses the original scalar desired pitch value and the time-varying intensity signal to generate a sequence of coefficient sets. The input pitch is used to search multidimensional filter coefficient set memory 202 for sustain codebooks which are associated with pitches which surround the desired pitch. Block 205 searches the sustain codebooks associated with these pitches to find, for each of the two codebooks, the filter coefficient set associated with the current input intensity value. It then interpolates between these two filter coefficient sets based on the input desired pitch. During the attack section of the tone, sequencer and interpolator 205 functions just as in the first mode of operation, generating a predetermined coefficient set sequence. During the release section of the tone, a choice can be made between the sustain section approach to filter coefficient set interpolation and the attack section, time based, approach.

Figure 10:
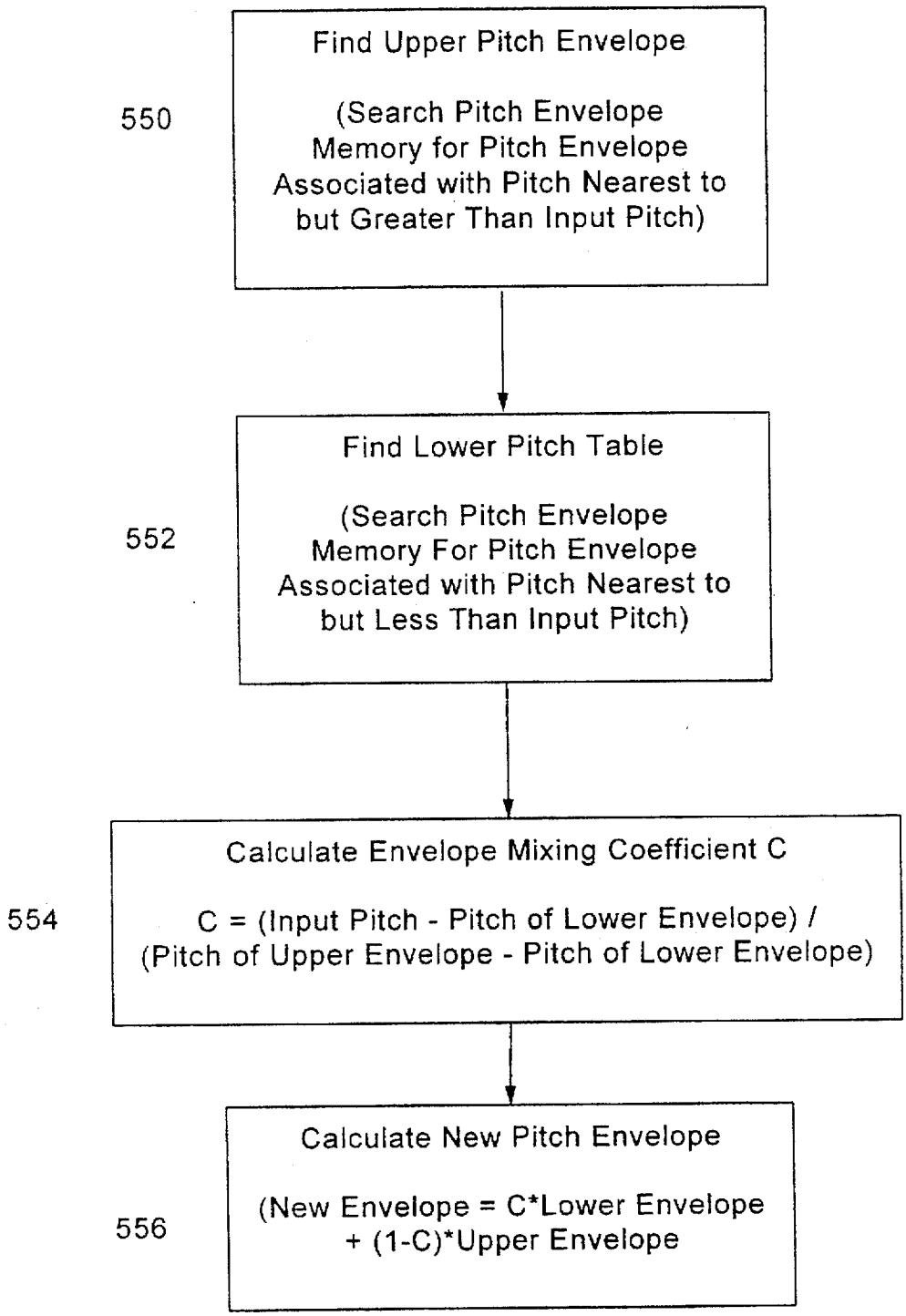
FIG. 10 is a flow diagram showing the process of generating the variable rate decimated pitch envelope during the note setup process of FIG. 6.

FIG. 13 shows the note setup process with the filter coefficient sequence based upon initial pitch and time-varying intensity. Step 600 receives the note request via input control signals including instrument, pitch and intensity. Step 602 generates the intermediate oscillator table in a manner similar to FIG. 7. Step 604 identifies upper and lower filter coefficient arrays based on input pitch (see FIG. 14). Step 606 generates a variable rate decimated pitch envelope as shown in FIG. 10.

Figure 14:
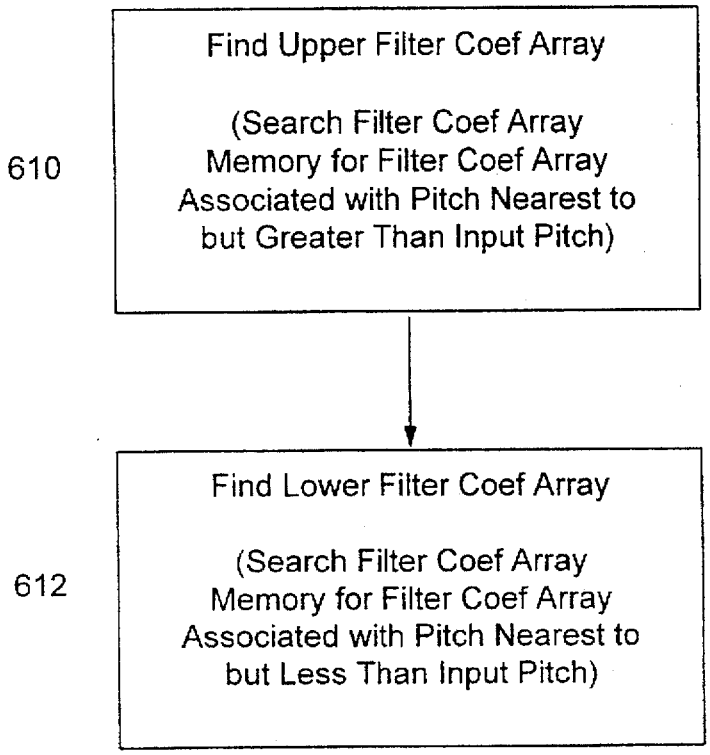
FIG. 14 is a flow diagram showing the process of identifying upper and lower filter arrays during the note setup process of FIG. 13, based upon initial pitch, for use by the frame by frame updating process of FIGS. 15, 16, and 17.

FIG. 14 shows the process of identifying upper and lower filter arrays based upon pitch. Step 610 finds the upper filter coefficient array by searching filter coefficient array memory 202 for the filter coefficient array associated with the pitch nearest to, but higher than, input pitch. Step 612 similarly finds the lower filter coefficient array.

FIG. 15 shows the frame-by-frame coefficient updating embodiment, based upon initial pitch and time varying input intensity. This varying intensity input to filter coefficient sequencer and interpolator 205 may be from an outside user, via control signals 111, or from amplitude envelope generator 211, via dotted line 131. The steps are identical to those shown in FIG. 11, with the following exceptions. Current frame filter coefficients are interpolated from upper and lower filter coefficient arrays, based upon input intensity in step 624 (see also FIGS. 16 and 17). In step 628, current frame amplitude is calculated from current input intensity, rather than from amplitude envelope 126.

FIG. 16 shows the process of calculating the current frame filter coefficient set based upon current frame input intensity and input pitch. Step 640 calculates an upper filter coefficient set by interpolating between filter sets in an upper filter coefficient set array based on current frame intensity. Step 642 similarly calculates a lower filter coefficient array. Both steps 640 and 642 are shown in more detail in FIG. 17. Step 644 calculates a filter coefficient set mixing coefficient C based upon the input pitch and the pitches of the upper and lower arrays. Step 646 calculates a new filter coefficient set based upon the upper and lower coefficient set and C.

Figure 17:
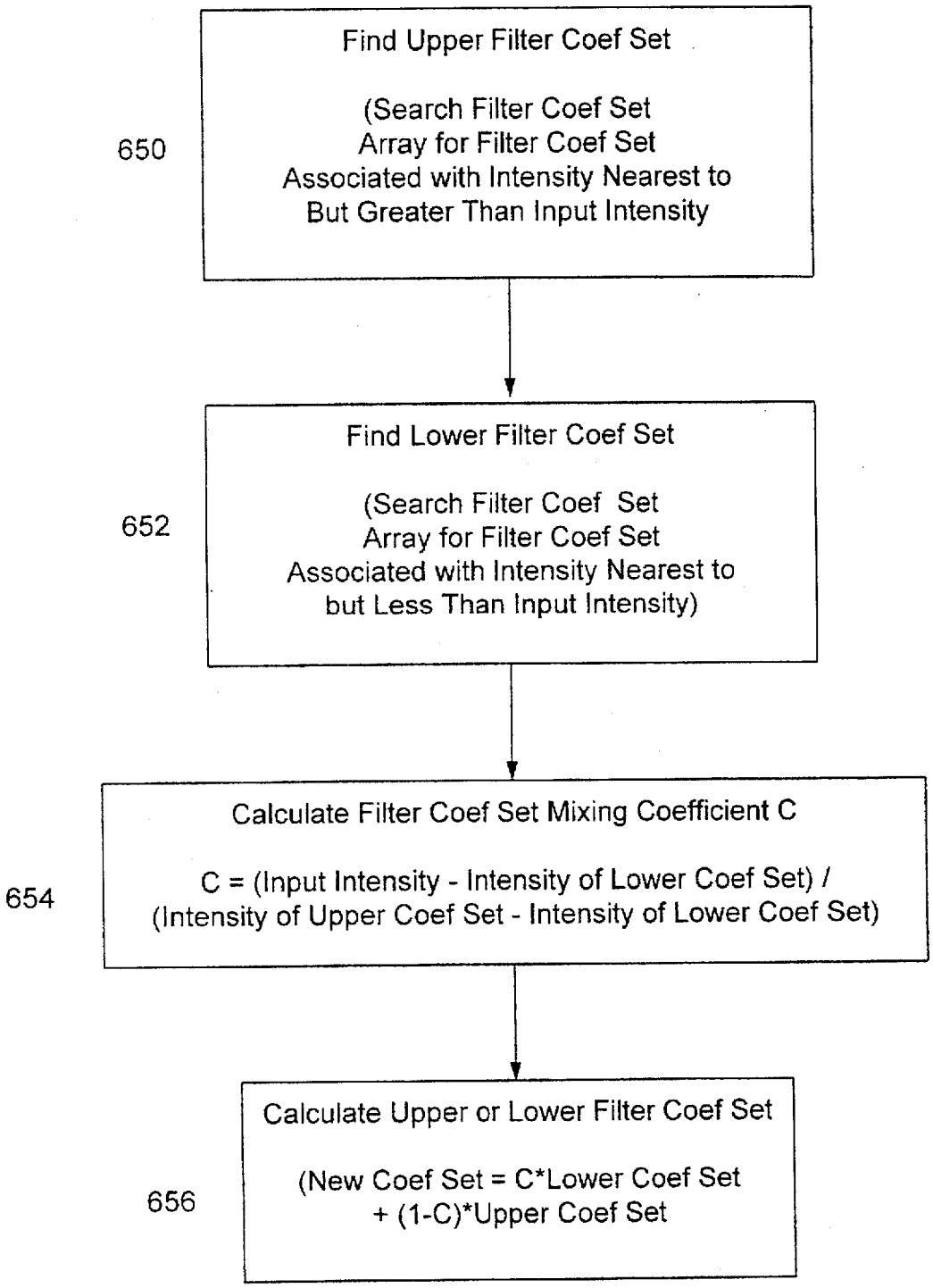
FIG. 17 is a flow diagram showing the process of calculating a new filter coefficient set based on current input intensity during the frame by frame updating process of FIG. 15.

FIG. 17 shows the process of calculating a new filter coefficient set, and comprises the steps performed within both step 640 and 642 of FIG. 16. Step 650 finds the upper coefficient set associated with the intensity nearest to but greater than the input intensity. Step 652 similarly finds a lower filter coefficient set. Step 654 calculates a mixing coefficient C based upon the intensities of the upper and lower sets and the input intensity. Step 658 calculates either the new upper or lower filter coefficient set based upon the original upper and lower sets and C.

FIG. 18 shows the sample by sample coefficient updating embodiment, based upon initial pitch and time varying input intensity. Pitch envelope generator 206 interpolates current sample pitch from the pitch envelope in step 660. Table lookup oscillator 207 generates one sample of oscillator output at current sample pitch in step 662. Time varying filter generator 208 interpolates current sample filter coefficients from upper and lower coefficient set arrays based on pitch and time-varying intensity in step 664, and filters the oscillator output sample using the coefficients in step 666. In step 668, amplitude envelope generator calculates the current sample envelope from the current input intensity. Multiplier 209 multiplies the filtered sample output by the amplitude and outputs the product as output 140. Dotted window 138 is not included in this embodiment

Amplitude Envelope Generation for Pitched Signal Synthesis

Amplitude envelope builder 125 comprises amplitude memory 210 and amplitude envelope generator 211. Amplitude envelope builder 125 generates time-varying amplitude envelope 126. In one of the preferred embodiments shown in FIG. 3, the amplitude envelope is applied only as a post multiplier to the output 131 of filter generator 208. In the second mode of operation (shown as a dotted line in FIG. 3), a time decimated version of amplitude envelope 126 is also passed to filter coefficient sequencer and interpolator 205. In the latter mode, filter coefficient sequencer and interpolator 205 uses the original scalar desired pitch value and the time-varying decimated amplitude envelope 126 to generate a sequence of coefficient sets. The input pitch is used to search the Multidimensional Filter coefficient set memory 202 for sustain codebooks which are associated with pitches which surround the desired pitch. Generally, two surrounding pitches are found, and block 205 then searches the sustain codebooks associated with these pitches to find, for each of the two codebooks, the filter coefficient set associated with the current input amplitude envelope value. It then interpolates between these two filter coefficient sets based on the input desired pitch. During the attack section of the tone, sequencer and interpolator 205 functions, just as in the first mode of operation, generate a predetermined coefficient set sequence. During the release section of the tone, a choice can be made between the sustain section approach to filter coefficient set interpolation and the attack section, time based, approach.

Multidimensional amplitude envelope memory 210 stores representations of time-varying amplitude envelopes. Each envelope in memory 210 is associated with the pitch and intensity of the original tone from which the envelope was derived. The amplitude envelopes are divided into two sections: the attack envelope and the sustain envelope. In one embodiment, attack and sustain envelopes are stored in memory 210 as sequences of value, time pairs. Each pair represents the amplitude value which will be in effect at the associated time offset from the onset of the tone. In this discussion, sustain envelope refers to the time-varying amplitude control over the entire duration of the tone except for the first attack section. Attack envelope refers to the time-varying amplitude control over just the first attack section of the tone. All sustain envelopes stored in memory 210 share the same series of time offset values and are of the same length. Likewise, all attack envelopes stored in memory 210 share the same series of time offset values and are the same length. This allows the sustain and attack envelopes to be interpolated across pitch and intensity.

The time offset value for sustain envelopes is in units of an analysis frame. The time offset value for attack envelopes is in units of a single sample. Thus, attack envelopes have much greater temporal precision than amplitude envelopes. To generate a new attack and sustain envelope based on an input pitch and intensity, amplitude envelope generator 211 interpolates between entries in memory 210 in much the same way that filter coefficient sequencer and interpolator 205 interpolates between filter coefficient set sequences stored in filter coefficient set memory 202. That is, new sustain and attack envelopes are generated by linear combination of sustain and attack envelopes associated with surrounding points in pitch-intensity space which are stored in memory 210.

Figure 9:
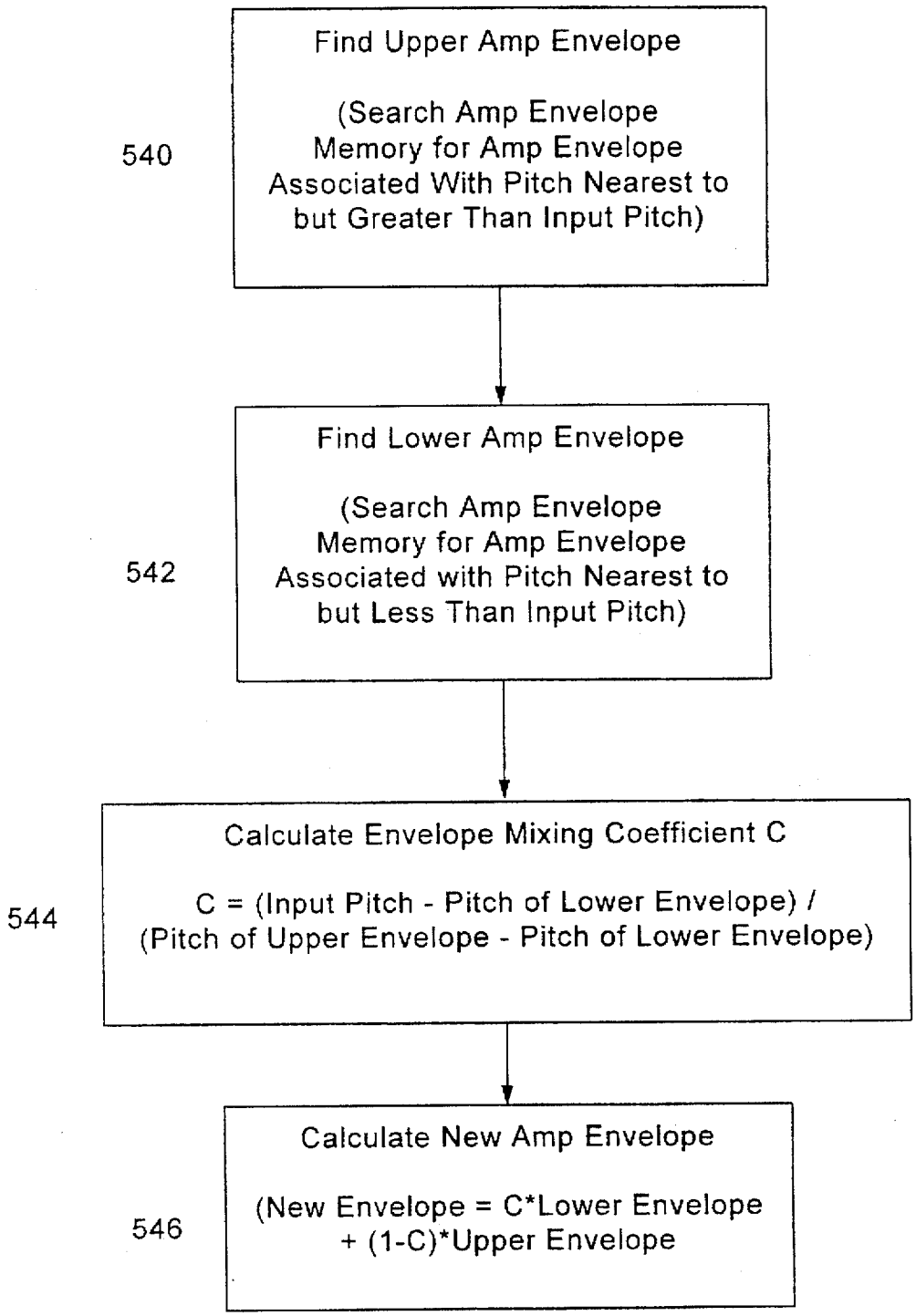
FIG. 9 is a flow diagram showing the process of generating the variable rate decimated amplitude envelope during the note setup process of FIG. 6.

FIG. 9 shows how amplitude envelope generator 211 interpolates between amplitude envelopes stored in memory 210, based only upon input pitch, to get a new decimated amplitude envelope. FIG. 9 corresponds to block 506 in FIG. 6. Step 540 finds the amplitude envelope associated with the nearest higher pitch to the input pitch. Step 542 finds the envelope associated with the nearest lower pitch. Step 544 calculates mixing coefficient C, and step 546 calculates a new amplitude envelope based upon the upper and lower envelopes and the mixing coefficient, C.

Once a new attack and sustain envelope are derived, they are linearly interpolated by amplitude envelope generator 211 over time, with the sustain envelope following immediately after the attack envelope. The sustain envelope is interpolated over time in two stages. In the first stage, it is interpolated up to the frame rate. This frame rate sustain envelope is passed to filter coefficient sequencer and interpolator 205. In the second stage, the frame rate sustain envelope is interpolated in time up to the sample rate. The resulting amplitude envelope is a sample by sample time-varying quantity which is multiplied by multiplier 209 with the filtered residual 131. This forms the pitched signal output which will be mixed with the noise signal output by adder 103 in FIG. 1 to produce the final synthesized tone 120.

In another embodiment, multidimensional envelope memory 210 does not store sustain envelopes as value, time pairs. Rather, it stores a statistical representation of the sustain envelope; that is, it stores a collection of coefficients such as those derived from Parametric Signal Modeling. This kind of model can account for overall trends—e.g., decay, periodicity—e.g., vibrato or tremolo, and various random variations. In this embodiment, the sustain envelope is generated by applying noise of appropriate mean and variance to a synthesis filter whose coefficients are derived by interpolation across pitch and intensity between sustain envelope coefficient sets stored in memory 210. Other approaches to statistical envelope modeling—e.g., more classical Markov chain models, hidden Markov models, etc.—can be used without departing from the general principles of the invention. The advantage of this statistical modeling of envelopes is that there will be a desirable variability between different realizations of a given tone. A statistical model also lends itself to arbitrary length sustains while preserving the random behavior of a real sustaining musical instrument. Another advantage of the statistical approach is related to interpolation of envelopes over pitch and intensity. Assume two amplitude envelopes associated with tones of two different pitches have a sinusoidal modulation of similar frequency associated with them—e.g., 3 Hz tremolo. It is possible that the phase relationships of the sinusoidal modulation are such that a linear combination of the two envelopes would cancel the oscillation. The parametric representation avoids this problem in that periodicities are encoded in particular coefficients and interpolating coefficients, assuming an appropriate statistical model—e.g., ARMA—will interpolate the magnitude of these modulations in an appropriate manner.

In still another embodiment of amplitude envelope builder 125, the time-varying amplitude envelopes are derived directly from real-time inputs, such as those provided by a performer equipped with a suitable continuous time electronic music controller—e.g., breath controller, pressure controller, motion controller, etc.

Pitch Envelope Generation for Pitched Signal Synthesis

Pitch envelope builder 120 comprises pitch envelope memory 203 and pitch envelope generator 206. Pitch envelope builder 120 generates a time-varying pitch envelope 121 over the duration of the musical tone. Pitch envelope 121 is applied to table lookup oscillator 207.

Pitch envelope 121, which is used to provide modest time-varying pitch variation, is used to drive oscillator lookup table 207 so that vibrato, portamento, and random variation in pitch can be realized. The generation of pitch envelope 121 is very similar to the generation of the sustain envelope, described above. Pitch envelope 121 can be generated either from value-time pairs or from a statistical model. In either case, the envelope is generated based on interpolation of pitch envelope parameters stored in memory 203. As with amplitude envelopes 126, the interpolation is over pitch-intensity space and then over time.

FIG. 10 shows how pitch envelope generator 206 generates a new decimated pitch envelope by interpolating between envelopes stored in pitch envelope memory 203. FIG. 10 corresponds to block 506 in FIG. 6. In step 550, an upper pitch envelope is found, and in step 552, a lower pitch envelope is found. Step 554 calculates mixing coefficient C, and step 556 calculates a new decimated pitch envelope based upon the upper envelope, the lower envelope, and C.

As in the case of amplitude envelope builder 125, the time-varying pitch envelopes may be derived directly from real-time inputs such as those provided by a performer equipped with a suitable continuous time electronic music controller.

Noise Signal Generation

FIG. 4 shows one embodiment of a noise signal generator 101 (see FIG. 1). In this embodiment, the noise signal generation process is quite similar to the pitched signal generation process except that the excitation signal is white noise from white noise generator 305 rather than a periodic signal. The white noise is filtered by a time-varying filter. Filter coefficient set sequences for this filter are derived in much the same way as for the pitched signal generation. Generally there are fewer entries in filter coefficient set memory 301 compared to pitched signal generation. The amplitude envelope generator 304 is also similar to the pitched signal case with attack and sustain sections. As with the pitched signal case, the filter coefficient set sequence can be generated automatically from a stored time sequence or it can be generated in response to the time-varying amplitude envelope. The sustain envelope section of the amplitude envelope can be generated from value-time pairs or from a statistical model. There is no pitch envelope associated with noise signal generation.

Figure 19:
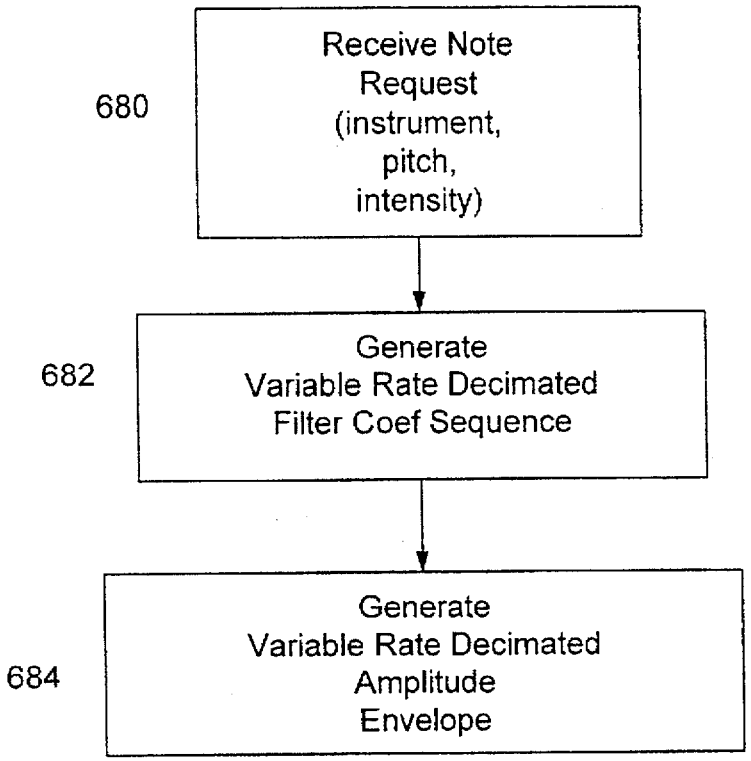
FIG. 19 is a flow diagram showing the note setup process for generating filtered noise with the noise signal generator of FIG. 4, based upon initial pitch and intensity.
Figure 20:
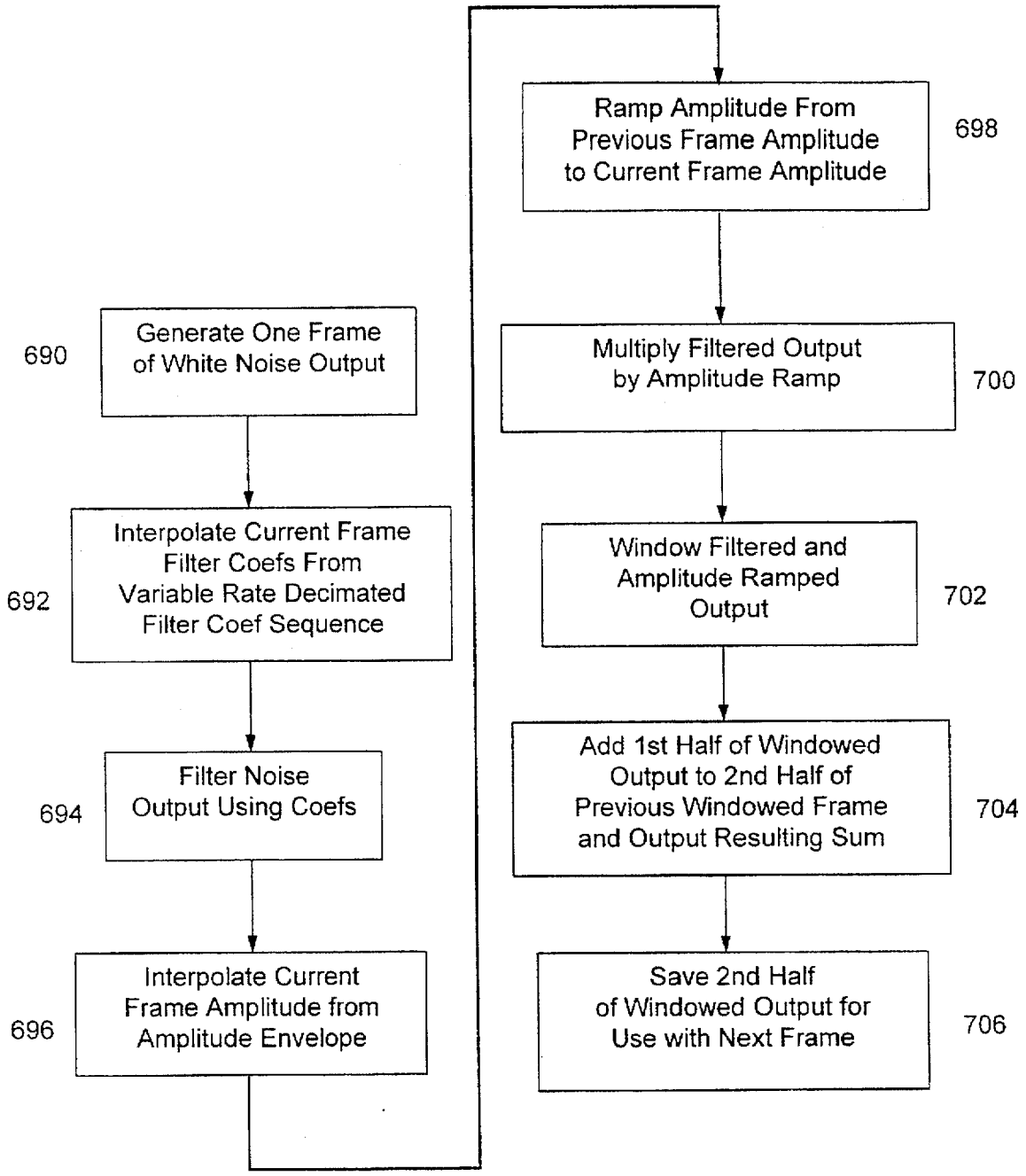
FIG. 20 is a flow diagram showing the frame by frame noise signal smoothing process for the noise signal generator of FIG. 4, based upon initial pitch and intensity.
Figure 21:
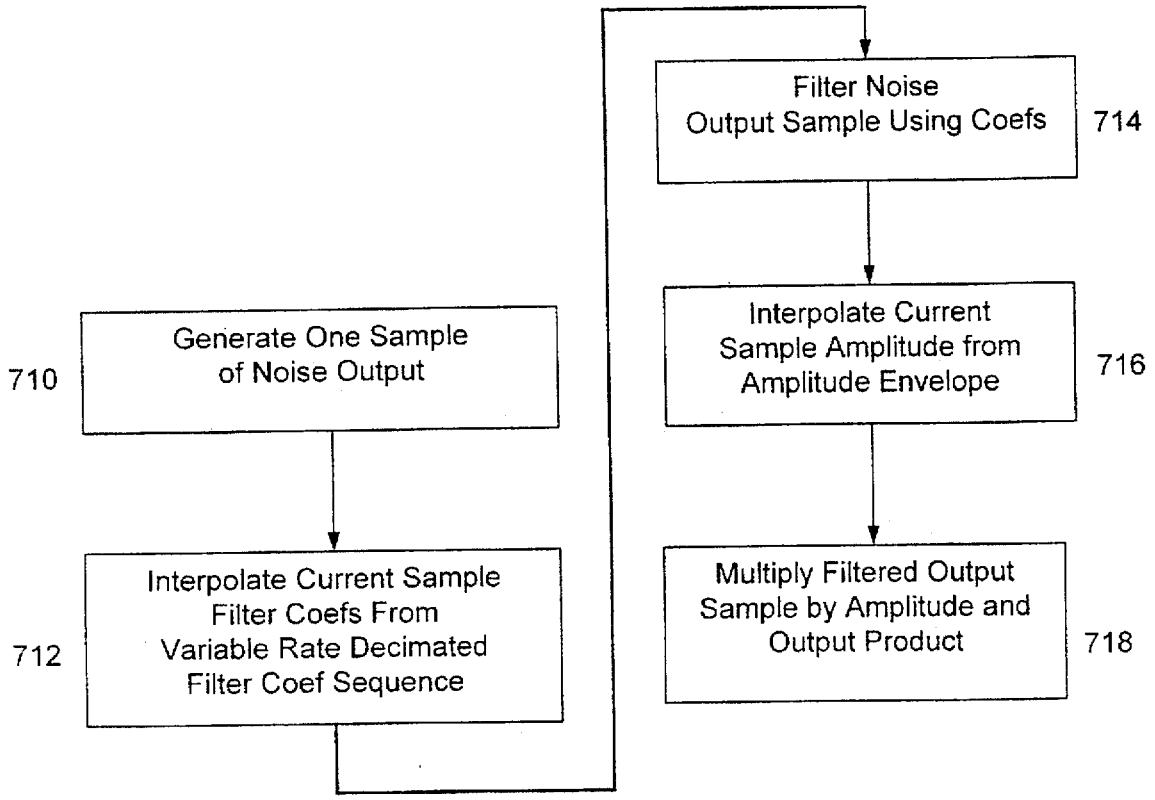
FIG. 21 is a flow diagram showing the sample by sample noise signal smoothing process for the noise signal generator of FIG. 4, based upon initial pitch and intensity.
Figure 22:
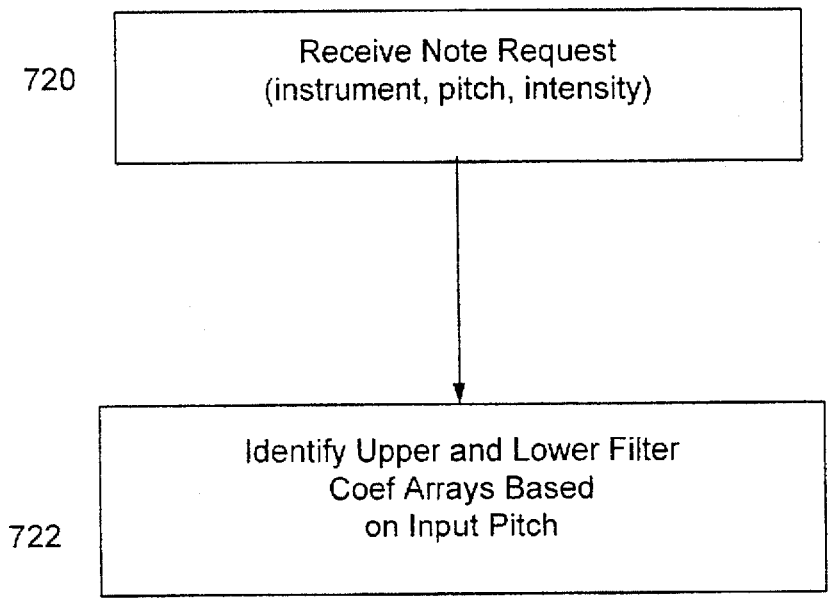
FIG. 22 is a flow diagram showing the note setup process for generating filtered noise with the noise signal generator of FIG. 4, based upon initial pitch and time-varying intensity.
Figure 23:
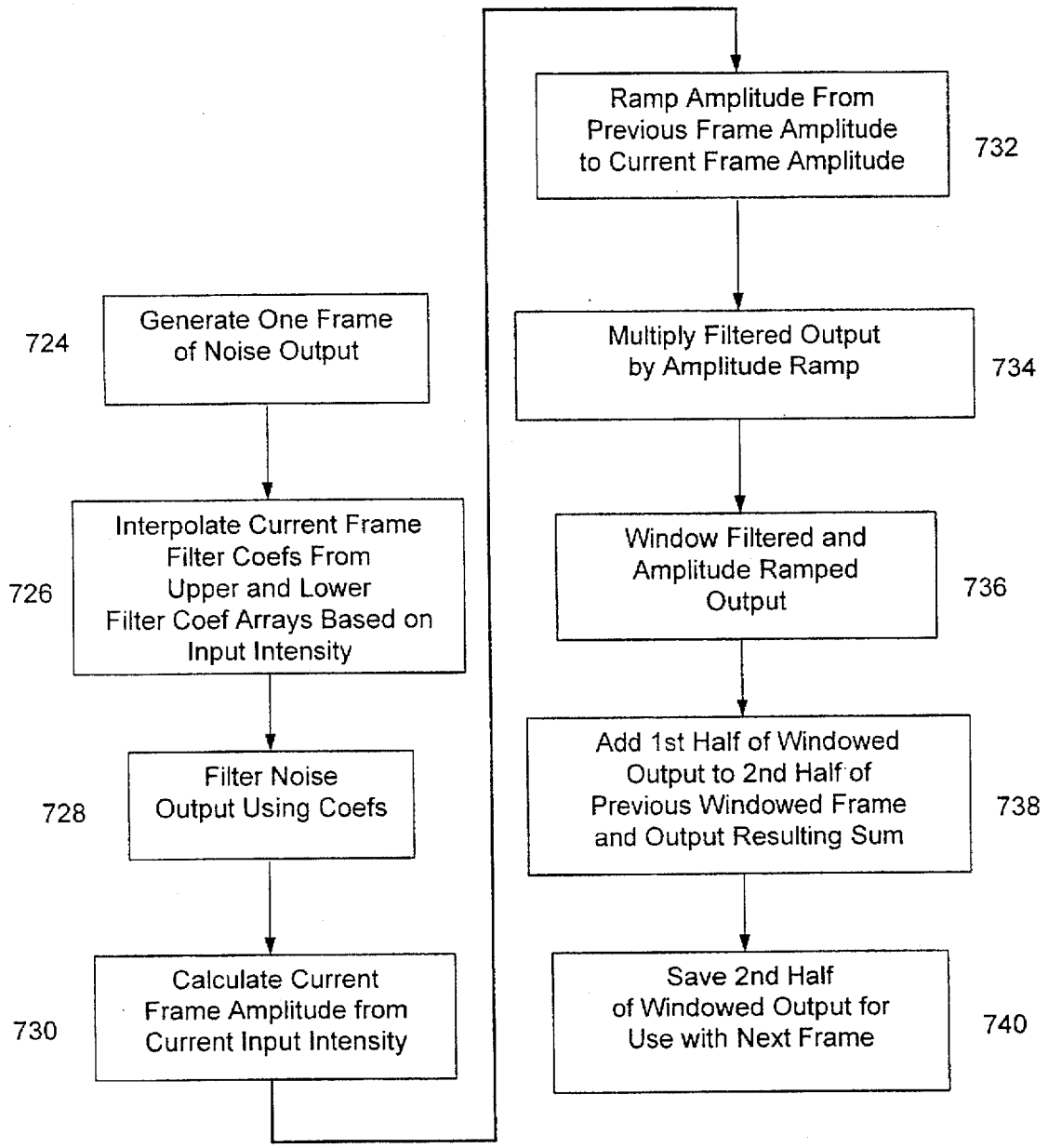
FIG. 23 is a flow diagram showing the frame by frame noise signal smoothing process for the noise signal generator of FIG. 4, based upon initial pitch and time-varying intensity.
Figure 24:
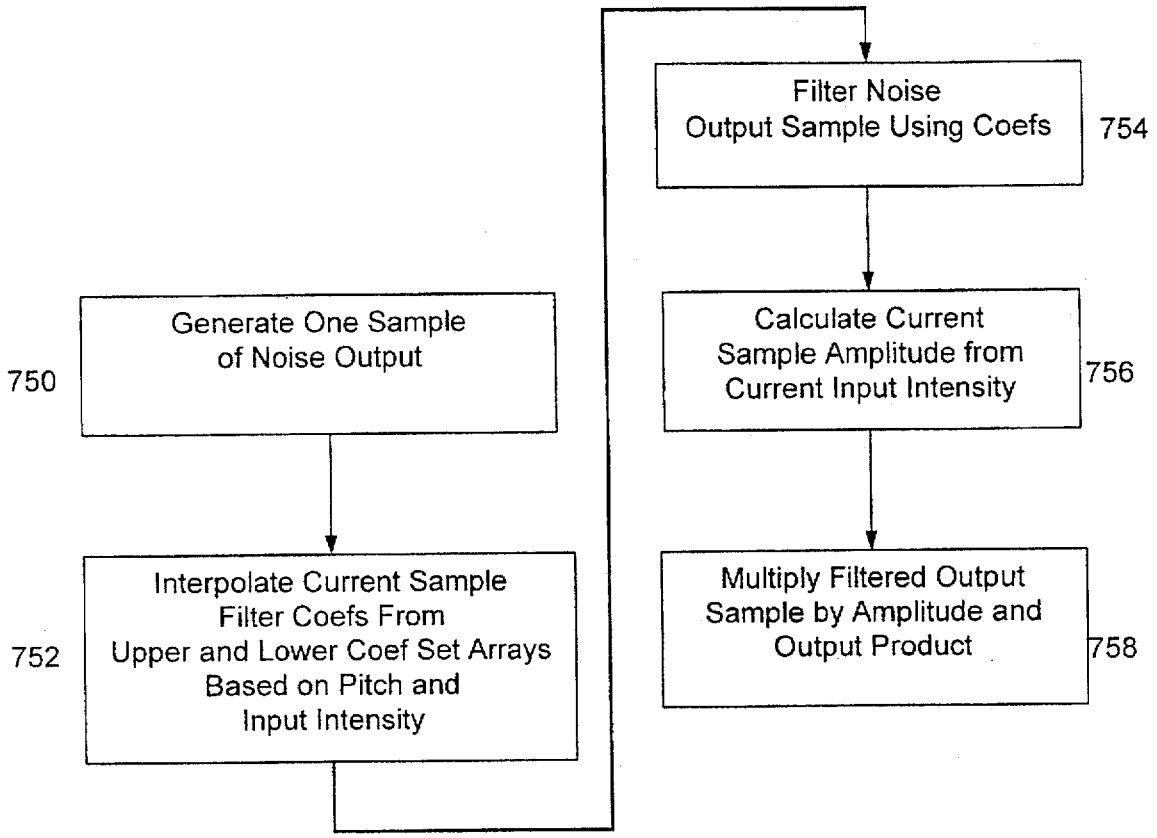
FIG. 24 is a flow diagram showing the sample by sample noise signal smoothing process for the noise signal generator of FIG. 4, based upon initial pitch and time-varying intensity.

The noise signal generator 101 of FIG. 4 can generate noise signal 150 based upon either initial pitch and intensity (as shown in FIGS. 19, 20, and 21), or upon initial pitch and time varying intensity (as shown in FIGS. 22, 23, and 24).

FIG. 19 shows note setup for noise signal generator 101 based upon initial pitch and intensity. A note request comprising instrument, pitch and intensity is received via control inputs 111 in step 680. In step 682, filter coefficient sequencer and interpolator 303 generates a decimated filter coefficient sequence from the data stored in memory 301. In step 684, amplitude envelope generator 304 generates a variable rate decimated amplitude envelope from the data stored in memory 302.

FIG. 20 shows the operation of the frame by frame embodiment of the noise signal generator of FIG. 4. In step 690, white noise generator 305 generates one frame of white noise. In step 692, time varying filter generator 306 interpolates the current frame filter coefficients from the variable rate decimated filter coefficient sequence. In step 694, filter generator 306 filters the noise output using the current frame coefficients. In step 696, amplitude envelope generator 304 interpolates the current frame amplitude from the amplitude envelope. In step 698, amplitude envelope generator 304 ramps the amplitude from the previous frame amplitude to the current frame amplitude. Multiplier 307 multiplies the filtered output by the amplitude ramp in step 700. Window 310 (shown in the dotted box) windows the filtered and amplitude ramped output in step 702, adds the first half of the current windowed output to the second half of the previous windowed frame in step 704, and saves the second half of the current windowed output for use with the next frame.

FIG. 21 shows the operation of the sample by sample embodiment of the noise signal generator of FIG. 4. In step 710, white noise generator 305 generates one sample of white noise. In step 712, filter generator 306 interpolates current sample filter coefficients from variable rate decimated filter coefficient sequence. In step 714, filter generator 306 filters the noise using the current coefficients. In step 716, amplitude envelope generator 304 interpolates a current sample amplitude from the amplitude envelope. In step 718, multiplier 307 multiplies the filtered output sample by the amplitude to form noise signal 150. Window 310 is not part of this configuration.

FIG. 22 shows the note setup process for generating filtered noise with the noise signal generator of FIG. 4, based upon initial pitch and time-varying intensity. Step 720 receives the note request. Step 722 identifies upper and lower filter coefficient arrays based on input pitch.

FIG. 23 shows the frame by frame noise signal smoothing process for the noise signal generator of FIG. 4, based upon initial pitch and time-varying intensity. White noise generator 305 generates one frame of output noise in step 724. Time varying filter generator 306 interpolates current frame filter coefficients from upper and lower arrays based on current input intensity in step 726. Time varying filter generator 306 filter noise using the current coefficients in step 728. Amplitude envelope generator 304 calculates current frame amplitude from current input intensity in step 730, and ramps the amplitude from the previous frame amplitude to the current frame amplitude in step 732. Multiplier 307 multiplies the filtered output by the amplitude ramp in step 734. Window 310 (shown as a dotted box in FIG. 4) windows the filtered and amplitude ramped output in step 736, adding the first half of the current output to the second half of the previous frame output in step 738 and saving the second half of the current output in step 740.

FIG. 24 shows the sample by sample noise signal smoothing process for the noise signal generator of FIG. 4, based upon initial pitch and time-varying intensity. In step 750, white noise generator 305 generates one sample of noise output. In step 752, time varying filter generator 306 interpolates current filter coefficients from the upper and lower arrays based on input pitch and current intensity, and in step 754, filter generator 306 filters the noise output using the current coefficients. Amplitude envelope generator 304 calculates the current sample amplitude from current input intensity. Multiplier 307 multiplies the current amplitude by filtered output in step 758. Window 310 is not part of this configuration.

FIG. 5 shows a second embodiment of a noise signal generator. In this case, the noise is simply sampled, using a technology similar to traditional wavetable synthesis, and stored in noise sample memory 401. The justification for this is that certain noise signals, such as the attack related knock of a piano tone, are short in length and can be highly decimated since they are largely lowpass signals. These signals also don't have to be pitch shifted very much, so timbral distortions are not a serious problem. Since the noise attack is not extremely exposed, it is often possible to use just one sampled signal for the entire instrument. These factors combine to make the traditional wavetable synthesis approach to noise attack modeling an attractive alternative. The white noise through a time-varying filter approach is better suited to continuous non-attack related noises such as violin bow scrapes.

Noise sample readout and interpolator 403 reads out the appropriate sample from noise sample memory 401 based on desired instrument and pitch, and interpolates between the decimated data points to form a fairly realistic noise signal. Amplitude envelope generator 404 generates an amplitude envelope from data stored in amplitude envelope memory 402 based upon instrument, pitch and intensity. This amplitude envelope is multiplied together with the noise signal from noise sample readout and interpolator 403 by multiplier 405. The amplitude envelope may also control the noise sample readout and interpolator 403 in a manner similar to how amplitude envelope generator 211 controls filter coefficient sequencer and interpolator 205 in FIG. 3.

Figure 25:
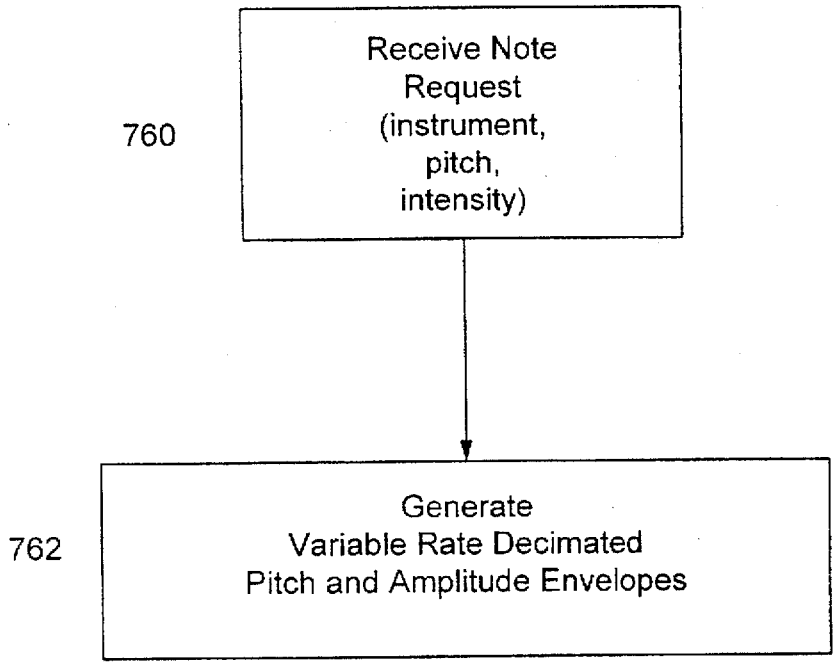
FIG. 25 is a flow diagram showing the note setup process for generating filtered noise with the noise signal generator of FIG. 5, based upon initial pitch and intensity.
Figure 26:
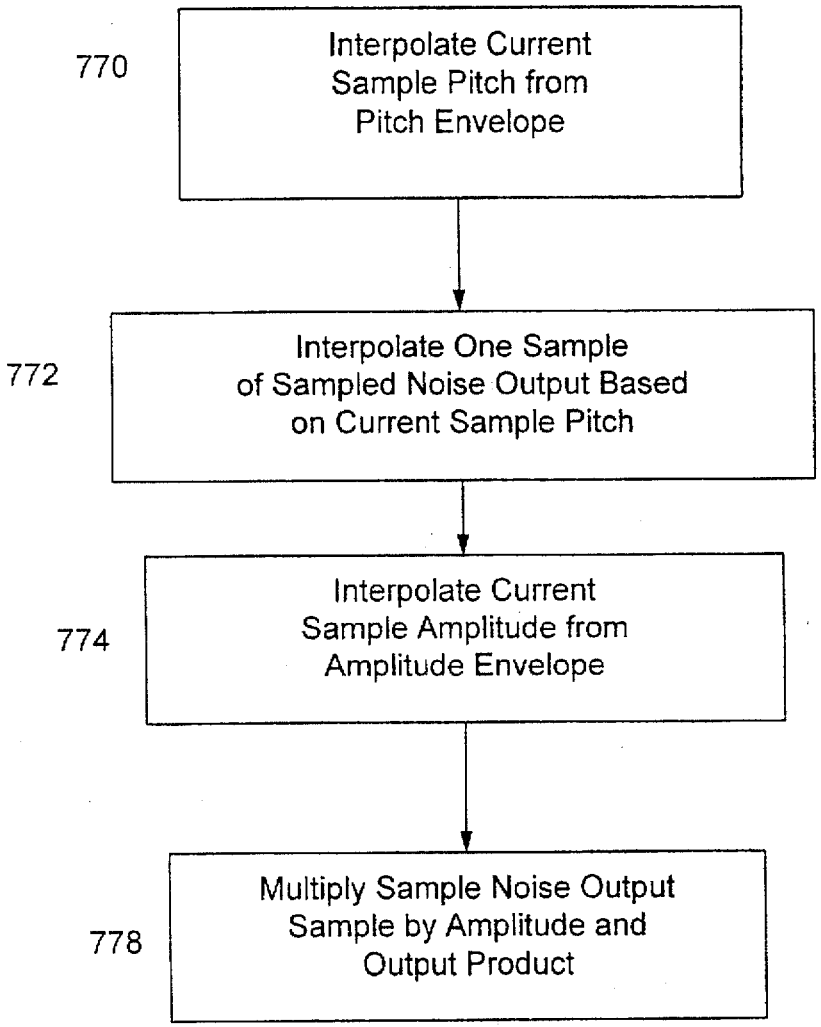
FIG. 26 is a flow diagram showing the sample by sample noise signal smoothing process for the noise signal generator of FIG. 5, based upon initial pitch and intensity.

FIGS. 25 and 26 show the process of generating noise signal 150 with sampled noise signal generator 101 of FIG. 5. In step 760 of FIG. 25, noise signal generator 101 receives control data 111, consisting of input instrument, pitch and intensity. In step 762, a variable rate decimated amplitude envelope (and, optionally, pitch envelope) is generated by amplitude envelope generator 404 from data in memory 402. The blocks for forming a pitch envelope are not specifically shown in FIG. 5, but operate similarly to blocks 203 and 206 in FIG. 3. In step 770 of FIG. 26, a current sample pitch is interpolated from the pitch envelope (if used) and in step 772, a sample of sampled noise output from memory 401 is interpolated by noise sample readout and interpolator 403 according to current pitch (whether input pitch or interpolated pitch from pitch envelope) and, optionally, amplitude from amplitude envelope generator 404. In step 774, current sample amplitude is interpolated by amplitude envelope generator 404 based on data from memory 402. In step 778, multiplier 405 multiplies

Generation of Stored Tables

The data stored in oscillator table memory 201, filter coefficient set memory 202, and envelope memories 203 and 210 may be derived in a number of ways. Below is one method of deriving this data.

The Elements of the Instrument Parameter Space may be derived from Parametric Signal Modeling of a set of recorded musical tones of an instrument. The set includes tones with pitches which cover the range of the instrument —e.g., one tone per octave. For each pitch a set of recorded tones of different intensities—e.g., soft, medium, and loud—is analyzed. The analysis begins with separation of the signal into a noise and pitched part. This separation is carried out in the following manner:

1) A Short Time Fourier Transform (STFT) analysis is performed on the recorded signal. This consists of taking the Fourier transforms of overlapping hanning windowed segments of the signal. These segments will be referred to as analysis frames. The window length for pitch analysis is 46 milliseconds or 1024 samples at 22050 kHz sampling rate, and the overlap between successive frames is 23 milliseconds.
2) The 512 frequency points generated by the Fourier transform of each 1024 length windowed frame are divided into a number of sub-bands, such that each sub-band has a bandwidth large enough to span N harmonics of the signal, where N is typically 4–8.

Beginning with the lowest sub-band a filter in the form of a frequency domain vector with equally spaced nulls, that is, a frequency domain all zero comb filter, is multiplied with the magnitude of the frequency points in the sub-band and the resulting vector product is integrated to generate an amplitude value. For a given sub-band, the spacing of the filter nulls is gradually expanded, beginning with a spacing known to be less than the spacing of the harmonics in the sub-band. After each expansion of the spacing the integration over frequency is repeated. The filter spacing which yields the smallest amplitude is selected as the separation filter for that sub-band because it is assumed to be the one which has most successfully canceled harmonics in that sub-band. The residual frequency domain vector after the harmonics have been canceled is the frequency domain noise vector in the sub-band. In successive sub-bands the first filter null is positioned with respect to the last null of the next lower sub-band in such a way that the interval between these two nulls is equal to the interval of the last two nulls of the next lower sub-band. This provides continuity from one sub-band to the next. Since the analysis is made in sub-bands the harmonic spacing can vary from one sub-band to the next allowing pitch and noise separation of signals with out of tune harmonics. The noise residual sub-bands are concatenated to form a single frequency vector. This is the frequency domain representation of the noise part of the signal for the current frame. The noise frequency domain vector is subtracted from the original frequency domain vector for this frame to form the pitched frequency domain vector. This process of forming noise and pitched frequency domain vectors is carried out for every frame. The determination of the comb filter which yields minimum amplitude in the lowest sub-band also serves to determine the actual pitch in the frame. The frame by frame pitch is stored to form the pitch envelope of the signal.

3) The noise and pitched frequency domain vectors for each frame are inverse Fourier transformed to form pitched and noise time domain synthesis frames.

4) The noise synthesis frames are overlap added to form the noise signal. The pitched synthesis frames are overlap added to form the pitched signal. This concludes the division of the recorded signal into pitched and noise signals.

After division of each recorded signal into pitched and noise parts, the pitched parts undergo Parametric Signal Modeling. Although Parametric Signal Modeling can take many forms, the examples referred to in this disclosure use the following method:

1) A Short Time Fourier Transform (STFT) analysis is applied to the pitched signal. This time the analysis is done in shorter 23 millisecond frames—512 points at 22050 sample rate—to improve temporal resolution.

2) The power spectrum—magnitude squared—of each frequency domain frame is calculated.

3) A smooth envelope of the power spectrum for each frame is generated. The smoothed power spectrum is intended to show the contours of the power spectrum, but with no pitch detail. This is accomplished by dividing the frequency spectrum into sub-bands approximately equal in bandwidth to the fundamental pitch under analysis. The maximum power value in each sub-band is found. Then an envelope which linearly interpolates between the sub-band maxima is generated. This smoothed spectral envelope will provide the basis for the parametric modeling whose purpose is to generate coefficients of a filter whose magnitude transfer function is as close as possible to this smoothed spectral envelope. The reason we model the smoothed spectrum, that is a spectrum which has no pitch information, is that later we will pass pitched residual excitation signals through this filter with the purpose of obtaining a signal whose spectrum matches the original. The residual excitations may differ in pitch from the original signal. If the filter magnitude spectrum contained details related to a specific pitch then different pitched excitation inputs would undergo severe spectral distortion. By using, as the basis of parametric modeling, a smoothed spectrum which matches the harmonic peaks of the original signal, rather than average energy of the original signal, we are able to resynthesize a signal with the same harmonic peaks.

4) The smoothed power spectrum for each frame is resampled across frequency on a nonlinear warped scale. The warping function is based on the bilinear transform as described in "Techniques for digital filter design and system identification with application to violin" by J. O. Smith, 1988 Stanford University PhD. Dissertation. This increases the number of frequency points at low frequencies while decreasing the number of frequency points at high frequencies. The purpose of this is to promote greater detail at low frequencies in the subsequent parametric analysis. This distribution of detail matches the analytic properties of the human auditory system.

5) The smoothed and warped power spectrum for each frame is inverse transformed to form a smoothed and warped autocorrelation function for each frame.

6) The first L points of the autocorrelation function for each frame are used to form an autocorrelation matrix for each frame which is inverted using a Levinson (see *Linear Prediction of Speech,* J. D. Markel et al, Springer-Verlag, 1980) procedure to yield a set of Lth order all pole AR filter parameters.

7) The AR filter parameters are unwarped using an inverse warping formula. The unwarped AR filter parameters for each frame are used to form the inverse of the all pole filter, this is an all zero filter which is used to filter the original windowed signal of each frame to generate a windowed residual for each frame. The filtering generates an output which is longer, due to convolution properties, than the original windowed frame.

8) The filtered longer residual frames are overlap added to form the residual excitation signal.

9) The unwarped AR coefficients for each frame are stored as the filter coefficient set sequence for this signal. The signal amplitude and residual power for each frame are also stored. The frame by frame signal amplitude forms the basis of the amplitude envelope of the analyzed signal.

To Further clarify terminology relating to filter coefficients, there is a filter coefficient set associated with each analysis frame. The number of coefficients in this set is a function of the order of the analysis filter. The filter coefficient sets for successive analysis frames form a sequence of filter coefficient sets. This terminology will be used throughout this disclosure.

The amplitude envelope described above lacks sufficient temporal detail in the transient attack section of the recorded signal. Therefore, a more detailed analysis is performed on this part of the signal. This attack envelope analysis is carried out as follows:

1) The attack region of the signal is selected manually. This corresponds to the first 100 to 200 milliseconds of the signal.
2) The attack section is segmented into nonoverlapping frames with the length of the frame equal to 1/(approximate pitch) of the signal.
3) The sum of squared magnitudes is formed in each frame. This forms the pitch synchronous power sequence of the attack section.
4) The pitch synchronous power sequence is doubly differentiated and the point at which the second order differentiated sequence shows a large negative value is identified. This point reflects the point at which the pitch synchronous power envelope reaches a large value and then flattens out. This is the upper knee of the initial attack.
5) The part of the attack section which precedes the upper knee is again segmented into nonoverlapping frames with the frame length this time one fourth of the original frame length. A frame by frame power analysis is performed on these shorter frames.
6) The short frame analysis is concatenated with the longer frame analysis to form the high definition attack envelope. The upper knee point is also saved.

The reasons for the multiple time resolution attack envelope power analysis is that while the signal is in the very first part of the attack, prior to the upper knee, a fine detail is necessary to capture the true temporal variation of the amplitude envelope. After the upper knee of the attack this fine resolution would be detrimental since it would track the periodicity of the time waveform and thus would not reflect a true amplitude envelope.

Thus, associated with each analyzed recorded signal is a residual excitation, a sequence of filter coefficient sets, an amplitude envelope, a pitch envelope, and an attack envelope. These elements or quantities derived from them will form the basis of the Instrument Parameter Space.

While the exemplary preferred embodiments of the present invention are described herein with particularity, those skilled in the art will appreciate various changes, additions, and applications other than those specifically mentioned, which are within the spirit of this invention.

What is claimed is:

1. An electronic musical tone generator for generating an electrical output signal representing a musical tone in response to an input control signal, said musical generator comprising:

an excitation signal generator responsive to said input control signal for generating an excitation signal; and a formant filter generator responsive to said input control signal for generating a time varying formant filter for filtering said excitation signal in a time varying manner to create the output tone signal;

wherein said formant filter generator includes instrument parameter memory means for storing a plurality of sets of filter coefficients;

intermediate parameter set generation means for deriving an intermediate filter coefficient set by interpolating between at least two of the sets of filter coefficients stored in instrument parameter memory based upon said input control signal; and time varying parameter generation means for interpolating within said intermediate filter coefficient set to generate said time varying formant filter.

2. The electronic musical generator of claim 1, further including:

a tone amplitude envelope builder for building a tone amplitude envelope including:

a multidimensional tone amplitude envelope memory for storing sets of data, each set for defining an envelope shape; and a tone amplitude envelope generator responsive to said input control signal for interpolating between at least two stored sets of data to generate a tone amplitude envelope; and means for combining said tone amplitude envelope with said filtered excitation signal.

3. The electronic musical generator of claim 2, wherein said formant filter generator is responsive to said tone amplitude envelope.

4. The musical generator of claim 1, further including a pitch envelope builder for building a pitch envelope, and wherein said excitation signal generator is responsive to said pitch envelope.

5. The musical generator of claim 1 wherein said control signal comprises initial pitch, initial intensity, and desired instrument.

6. The musical generator of claim 1 wherein said control signal comprises initial pitch, time-varying intensity, and desired instrument.

7. An electronic musical tone generator for generating an output tone signal representing a musical tone in response to an input control signal representing desired pitch, said musical generator comprising:

an excitation signal generator responsive to said input control signal for generating an excitation signal; said excitation signal generator including a multidimensional table oscillator memory for storing sets of oscillator data;

an oscillator selector and interpolator for selecting at least two of the sets of oscillator data according to said control signal and interpolating between said sets of oscillator data to form an intermediate oscillator data table; and a table lookup oscillator for reading out data from the intermediate oscillator data table over time; and a formant filter generator responsive to said input control signal for generating a formant filter for filtering said excitation signal in a time varying manner to create the pitched signal; said formant filter generator including a multidimensional filter coefficient set table memory for storing sets of filter coefficients;

a filter coefficient sequencer and interpolator for selecting at least two of the sets of filter coefficients according to said control signal and interpolating between them to form a variable rate decimated filter coefficient sequence; and a time varying filter generator for interpolating among the coefficients forming the decimated filter coefficient sequence over time to generate a series of filter coefficient sets for use in creating said formant filter.

8. The musical generator of claim 7, wherein:

said table lookup oscillator includes means for reading out one frame of oscillator data at a predetermined frame rate;

said time varying filter generator includes means for generating a filter coefficient set at the predetermined frame rate; and said musical generator further including a window for retaining a second portion of each filtered excitation signal frame and adding the second portion to a first portion of a succeeding filtered excitation signal frame.

9. The musical generator of claim 7 wherein:

said table lookup oscillator includes means for reading out one sample of oscillator data at a predetermined sample rate; and said time varying filter generator includes means for generating a filter coefficient set at the predetermined sample rate.

10. A method for generating a musical tone in response to an input control signal, comprising the steps of:

interpolating between data stored in an oscillator data table memory based upon the input control signal to generate an excitation signal;

interpolating between sets of filter coefficients stored in a filter coefficient table memory based upon the input control signal to generate an intermediate filter coefficient set;

interpolating within the intermediate filter coefficient set to generate a formant filter; and filtering the excitation signal with the formant filter to generate a tone.

11. An electronic musical tone generator for generating an electrical output signal representing a musical tone in response to an input control signal, comprising:

an oscillator table memory for storing a plurality of oscillator tables;

means for generating an excitation signal, including means for selecting and interpolating between at least two oscillator tables stored in the oscillator table memory, based upon the input control signal, to form a new oscillator table, and means for generating an excitation signal based upon the new oscillator table;

a filter coefficient data memory for storing sets of filter coefficients;

means for interpolating between sets of filter coefficients stored in a filter coefficient memory based upon the input control signal to generate an intermediate filter coefficient set;

means for interpolating within the intermediate filter coefficient set to generate a formant filter; and means for filtering the excitation signal with the formant filter to generate a tone.

12. The musical tone generator of claim 11, further comprising:

a noise signal generator for generating a noise signal; and means for combining the electrical output signal with the noise signal.

13. The musical tone generator of claim 12, wherein said noise signal generator comprises:

a noise memory for storing sampled noise data;

means for reading out the sampled noise data to generate the noise signal.

14. The musical tone generator of claim 13, further comprising means for reading out the noise signal at a variable rate.

15. The musical tone generator of claim 13, further comprising an amplitude envelope generator for generating an amplitude envelope, and means for combining the noise signal with the amplitude envelope.

16. The musical generator of claim 12 wherein said noise signal generator includes:

a white noise generator for generating white noise; and a time-varying noise filter, responsive to said input control signal, for filtering the white noise.

17. The musical generator of claim 16 wherein said time-varying noise filter comprises:

a multidimensional noise filter coefficient set memory for storing sets of filter coefficients; and means for selecting and interpolating among the sets of noise filter coefficients to form the noise filter.

18. The musical generator of claim 17 wherein said means for interpolating comprises:

a noise filter coefficient sequencer and interpolator for interpolating between the filter coefficient sets to form a variable rate decimated filter coefficient sequence; and a time varying noise filter generator for interpolating over time among the coefficients forming the decimated filter coefficient sequence to generate a series of filter coefficient sets for use in generating the time varying noise filter.

19. The musical tone generator of claim 17, wherein said control signal includes a signal representing tone intensity.

20. The musical tone generator of claim 17 or 18, wherein said input control signal is a variable input control signal, and said means for selecting and interpolating selects and interpolates among the sets of noise filter coefficients in real time to generate a time varying sequence based upon said variable input control signal.

21. The musical tone generator of claim 20, wherein said variable input control signal includes a variable signal representing desired tone pitch.

22. The musical tone generator of claim 20, wherein said variable input control signal includes a variable signal representing desired tone intensity.

23. The musical generator of claim 20 wherein said noise signal generator further includes:

a noise amplitude envelope generator; and means for combining the filtered white noise and the noise amplitude envelope.

24. The musical generator of claim 20 wherein said noise signal generator further includes:

a noise pitch envelope generator for generating a noise pitch envelope; and means for combining the filtered white noise and the noise pitch envelope.

25. The musical generator of claim 17 or 18, wherein said sets of filter coefficients comprise time varying sequences of filter coefficients, and said means for selecting and interpolating generates a new time varying sequence.

26. The musical tone generator of claim 25, wherein said means for selecting and interpolating generates the entire new time varying sequence when said input control signal is first received.

27. The musical tone generator of claim 25, wherein said means for selecting and interpolating generates the new time varying sequence on an ongoing basis as the tone progresses.

28. An electronic musical tone generator for generating an electrical output signal representing a musical tone in response to an input control signal, comprising:

means for generating an excitation signal;

a filter coefficient data table memory for storing sets of filter coefficients;

means for interpolating between sets of filter coefficients stored in the filter coefficient table memory based upon the input control signal to generate a formant filter; said means for interpolating including:

a formant filter coefficient sequencer and interpolator for interpolating between the filter coefficient sets to form a variable rate decimated filter coefficient sequence; and a time varying formant filter generator for interpolating over time among the coefficients forming the decimated filter coefficient sequence to generate a series of filter coefficient sets for use in creating the time varying formant filter; and means for filtering the excitation signal with the formant filter to generate a tone.

29. The electronic musical tone generator of claim 28, wherein said means for generating an excitation signal includes:

an oscillator table memory;

means for storing a continuously varying single period excitation in the oscillator table memory; and means for repeatedly reading out the single period excitation from the oscillator table memory, thereby forming the excitation signal.

30. The electronic musical tone generator of claim 28, wherein said control signal includes a signal representing tone intensity.

31. The electronic musical tone generator of claim 28, wherein said input control signal is a time variable input control signal, and said means for selecting and interpolating selects and interpolates among the sets of formant filter coefficients in real time to generate a time varying sequence responsive to the variable input control signal.

32. The musical tone generator of claim 31, wherein said variable input control signal includes a variable signal representing input pitch.

33. The musical tone generator of claim 31, wherein said variable input control signal includes a variable signal representing input intensity.

34. The musical generator of claim 31 further including:

an amplitude envelope generator; and means for combining the filtered excitation signal and the amplitude envelope.

35. The musical generator of claim 31 further including:

a pitch envelope generator; and means for combining the filtered excitation signal and the pitch envelope.

36. The musical tone generator of claim 31, wherein said excitation signal generating means generates said excitation signal only once when said input control signal is first received.

37. The musical tone generator of claim 28, wherein said sets of filter coefficients comprise time varying sequences of filter coefficients, and said means for selecting and interpolating generates a new time varying sequence.

38. The musical tone generator of claim 37, wherein said means for selecting and interpolating generates the entire new time varying sequence when said input control signal is first received.

39. The musical tone generator of claim 38, wherein said excitation signal generating means generates said excitation signal only once when said input control signal is first received.

40. The musical tone generator of claim 37, wherein said means for selecting and interpolating generates the new time varying sequence on an ongoing basis over the duration of the tone.

41. The musical tone generator of claim 40, wherein said excitation signal generating means generates said excitation signal only once when said input control signal is first received.

42. An electronic musical tone generator for generating an electrical output signal representing a musical tone in response to an input control signal, comprising:

a formant filter generator for generating a formant filter;

an oscillator table memory for storing a plurality of oscillator tables;

means for generating an excitation signal, including means for selecting and interpolating between at least two oscillator tables stored in the oscillator table memory, based upon the input control signal, to form a new oscillator table, and means for generating an excitation signal based upon the new oscillator table;

means for providing the excitation signal to the formant filter at a desired data rate; and means for filtering the excitation signal with the formant filter to generate the tone signal.

43. The electronic musical tone generator of claim 42, wherein:

said input control signal includes a time varying signal representing tone pitch; and the excitation signal generating means includes means for varying the excitation signal data rate responsive to the time varying signal representing tone pitch.

44. The electronic musical tone generator of claim 42, wherein said input control signal includes a time varying signal representing tone intensity; and further including:

means for varying the gain of the excitation signal responsive to the time varying signal representing tone intensity.

45. The musical tone generator of claim 42, wherein said excitation signal generating means selects and interpolates only once when said input control signal is first received.

46. The electronic musical tone generator of claim 42, wherein said oscillator tables comprise continuously varying single period excitations, and said excitation signal generating means further includes means for repeatedly reading out the single period excitations to form the excitation signal.

47. The electronic musical tone generator of claim 46, wherein the control signal includes a signal representing tone pitch, and the excitation signal generating means selects and interpolates between oscillator tables according to the tone pitch signal.

48. The electronic musical tone generator of claim 46, wherein the control signal includes a signal representing tone intensity, and the excitation signal generating means selects and interpolates between oscillator tables according to the tone intensity signal.

* * * * *

UNITED STATES PATENT AND TRADEMARK OFFICE

CERTIFICATE OF CORRECTION

PATENT NO. : 5,744,742

DATED : April 28, 1998

INVENTOR(S) : Lindemann et al.

It is certified that error appears in the above-identified patent and that said Letters Patent is hereby corrected as shown below:

Abstract, line 10, delete "modelled" and insert --modeled--.

Column 1, line 18, delete "musical tone" and insert --musical tones--.

Column 2, line 11, delete "there is still often" and insert --there are still often--.

Column 2, line 31, delete "U.S. Pat. No.," and insert --U.S. Pat. No. 5,248,845,--.

Column 4, line 14, delete "insures" and insert --ensures--.

Column 6, line 26, delete "from; for example" and insert --from, for example--.

Column 7, lines 22-23, delete "time varying filter" and insert --time-varying filter--.

Column 8, line 27, delete "time varying filter" and insert --time-varying filter--.

Column 9, line 30,delete "Rossum, U.S. Pat. No. and" and insert --Rossum, U.S. Pat. No. 5,111,727, and---.

UNITED STATES PATENT AND TRADEMARK OFFICE

CERTIFICATE OF CORRECTION

PATENT NO. : 5,744,742

DATED : April 28, 1998

INVENTOR(S) : Lindemann et al.

It is certified that error appears in the above-identified patent and that said Letters Patent is hereby corrected as shown below:

Column 9, line 36, delete "by the time varying filter" and insert --by time-varying filter--.

Column 9, line 41, delete "Time varying filter" and insert --Time-varying filter--.

Column 12, line 30, delete "calculation, than" and insert --calculation than--.

Column 14, line 17, delete "the time varying filter" and insert --the time-varying filter--.

Column 18, line 21, delete "time varying filter generator" and insert --time-varying filter generator--.

Column 19, line 15, delete "time varying input" and insert --time-varying input--.

Column 19, line 48, delete "time varying input" and insert --time-varying input--.

Column 19, line 52, delete "Time varying" and insert --Time-varying--.

UNITED STATES PATENT AND TRADEMARK OFFICE

CERTIFICATE OF CORRECTION

PATENT NO. : 5,744,742

DATED : April 28, 1998

INVENTOR(S) : Lindemann et al.

It is certified that error appears in the above-identified patent and that said Letters Patent is hereby corrected as shown below:

Column 19, line 61, delete "in this embodiment" and insert --in this embodiment.--.

Column 22, line 47, delete "time varying intensity" and insert --time-varying intensity--.

Column 22, line 60, delete "time varying filter" and insert --time-varying filter--.

Column 23, line 30, delete "Time varying filter" and insert --Time-varying filter--.

Column 23, line 32, delete "Time varying filter" and insert --Time-varying filter--.

Column 24, line 39, delete "multiplies" and insert --multiplies sample noise output sample by amplitude and output product.--.

UNITED STATES PATENT AND TRADEMARK OFFICE

CERTIFICATE OF CORRECTION

PATENT NO. : 5,744,742

DATED : April 28, 1998

INVENTOR(S) : Lindemann et al.

It is certified that error appears in the above-identified patent and that said Letters Patent is hereby corrected as shown below:

Column 24, line 50, delete "For each pitch a" and insert --For each pitch, a--.

Column 26, line 59, delete "To Further" and insert --To further--.

Column 27, line 54, delete "time varying formant" and insert --time-varying formant--.

Column 27, line 55, delete "time varying manner" and insert --time-varying manner--.

Column 27, line 65, delete "time varying parameter" and insert --time-varying parameter--.

Column 27, line 67, delete "time varying formant" and insert --time-varying formant--.

Column 28, line 44, delete "a time varying" and insert --a time-varying--.

Column 28, line 54, delete "a time varying filter" and insert --a time-varying filter--.

UNITED STATES PATENT AND TRADEMARK OFFICE

CERTIFICATE OF CORRECTION

PATENT NO. : 5,744,742

DATED : April 28, 1998

INVENTOR(S) : Lindemann et al.

It is certified that error appears in the above-identified patent and that said Letters Patent is hereby corrected as shown below:

Column 28, lines 60-67, and column 29, lines 1 and 2, should each be indented one tabbed space.

Column 29, line 7, delete "time varying filter" and insert --time-varying filter--.

Column 29, lines 31-36 should each be indented one tabbed space.

Column 30, line 15, delete "time varying noise" and insert --time-varying noise--.

Column 30, line 18, delete "the time varying" and insert --the time-varying--.

Column 30, line 27, delete "time varying sequence" and insert --time-varying sequence--.

Column 30, line 48, delete "time varying sequences" and insert --time-varying sequences--.

Column 30, line 52, delete "time varying sequence" and insert --time-varying sequence--.

UNITED STATES PATENT AND TRADEMARK OFFICE

CERTIFICATE OF CORRECTION

PATENT NO. : 5,744,742

DATED : April 28, 1998

INVENTOR(S) : Lindemann et al.

It is certified that error appears in the above-identified patent and that said Letters Patent is hereby corrected as shown below:

Column 30, lines 55-56, delete "new time varying sequence" and insert --new time-varying sequence--.

Column 31, line 5, delete "time varying formant" and insert --time-varying formant--.

Column 31, lines 8-9, delete "the time varying formant" and insert --the time-varying formant--.

Column 31, line 29, delete "time varying sequence" and insert --time-varying sequence--.

Column 31, line 50, delete "time varying sequences" and insert --time-varying sequences--.

Column 31, line 52, delete "time varying sequence" and insert --time-varying sequence--.

Column 31, line 55, delete "time varying sequence" and insert --time-varying sequence--.

Column 32, lines 2-3, delete "new time varying sequence" and insert --new time-varying sequence--.

UNITED STATES PATENT AND TRADEMARK OFFICE

CERTIFICATE OF CORRECTION

PATENT NO. : 5,744,742

DATED : April 28, 1998

INVENTOR(S) : Lindemann et al.

It is certified that error appears in the above-identified patent and that said Letters Patent is hereby corrected as shown below:

Column 32, lines 16-21 should each be indented one tabbed space.

Column 32, line 29, delete "time varying signal" and insert --time-varying signal--.

Column 32, line 33, delete "time varying signal" and insert --time-varying signal--.

Column 32, line 35, delete "a time varying" and insert --a time-varying--.

Column 32, line 38, delete "time varying signal" and insert --time-varying signal--.

Signed and Sealed this

First Day of September, 1998

Bruce Lehman

*Attest:*

BRUCE LEHMAN

*Attesting Officer*

*Commissioner of Patents and Trademarks*